US010251253B2

(12) United States Patent
Iwamoto et al.

(10) Patent No.: US 10,251,253 B2
(45) Date of Patent: Apr. 2, 2019

(54) EXTREME ULTRAVIOLET LIGHT GENERATION DEVICE

(71) Applicant: Gigaphoton Inc., Tochigi (JP)

(72) Inventors: Fumio Iwamoto, Oyama (JP); Tsukasa Hori, Oyama (JP); Toshiyuki Hirashita, Oyama (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 15/888,110

(22) Filed: Feb. 5, 2018

(65) Prior Publication Data

US 2018/0160519 A1 Jun. 7, 2018

Related U.S. Application Data

(63) Continuation of application No. PCT/JP2015/075904, filed on Sep. 11, 2015.

(51) Int. Cl.
*H05G 2/00* (2006.01)

(52) U.S. Cl.
CPC ..... *H05G 2/006* (2013.01); *H05G 2/00* (2013.01); *H05G 2/005* (2013.01); *H05G 2/008* (2013.01)

(58) Field of Classification Search
CPC ..... H05G 2/006; H05G 2/005; H05G 2/008; H05G 2/00
USPC ..... 250/504 R
See application file for complete search history.

(56) References Cited

U.S. PATENT DOCUMENTS

2012/0205559 A1 8/2012 Yabu et al.
2013/0032640 A1* 2/2013 Yabu ..... B05B 15/52 239/13
2013/0075625 A1* 3/2013 Yabu ..... H05G 2/005 250/428
2014/0138560 A1 5/2014 Umeda et al.

FOREIGN PATENT DOCUMENTS

| | | | |
|---|---|---|---|
| JP | 2005-268366 A | | 9/2005 |
| JP | 2005268366 A | * | 9/2005 |
| JP | 2012-169359 A | | 9/2012 |
| JP | 2013-037787 A | | 2/2013 |
| JP | 2013-073733 A | | 4/2013 |
| JP | 2014-068862 A | | 4/2014 |
| JP | 2014-102981 A | | 6/2014 |

OTHER PUBLICATIONS

International Preliminary Report on Patentability (IPRP)—PCT/IB/373, dated Mar. 13, 2018, from corresponding application PCT/JP2015/075904, 1 pp.
Written Opinion (WO)—PCT/ISA/237, dated Dec. 15, 2015, from corresponding application PCT/JP2015/075904, 8 pp.
International Search Report (ISR)—PCT/ISA/210, dated Dec. 15, 2015, from corresonding application PCT/JP2015/075904, 2 pp.

* cited by examiner

*Primary Examiner* — Michael Maskell
(74) *Attorney, Agent, or Firm* — Studebaker & Brackett PC

(57) ABSTRACT

An extreme ultraviolet light generation device may include a chamber in which a target is irradiated with laser light and extreme ultraviolet light is generated, and a target supply unit configured to eject a target into the chamber. The target supply unit may be provided with a nozzle member including an ejection face having an ejection port configured to eject the target into the chamber. An angle θ1 defined by the ejection face and the gravity axis may satisfy a condition of "0 degrees<θ1<90 degrees".

20 Claims, 13 Drawing Sheets

RELATED ART

FIG.13

CONTACT ANGLE OF MATERIALS TO MOLTEN Sn

| MATERIALS | CONTACT ANGLE (° ) |
|---|---|
| ALUMINUM | 43 |
| COPPER | 64 |
| SILICON | 79 |
| NICKEL | 80 |
| TITANIUM | 89 |
| MOLYBDENUM (VACUUM THERMAL PRETREATMENT) | 30~70 |
| SILICON CARBIDE | 123~150 |
| SILICON NITRIDE | 140~168 |
| ALUMINUM OXIDE | 163~163 |
| ZIRCONIUM OXIDE | 140~153 |
| BLACK LEAD | 149 |
| DIAMOND | 125~135 |
| SILICON OXIDE | 120~150 |
| MOLYBDENUM OXIDE (MOLYBDENUM NOT APPLIED WITH THERMAL PRETREATMENT) | 120~130 |

EXTREME ULTRAVIOLET LIGHT GENERATION DEVICE

CROSS-REFERENCE TO RELATED APPLICATIONS

The present application is a continuation application of international Application No. PCT/JP2015/075904 tiled on Sep. 11, 2015. The content of the application is incorporated herein by reference in its entirety.

BACKGROUND

1. Technical Field

The present disclosure relates to an extreme ultraviolet light generation device.

2. Related Art

In recent years, along with miniaturization of a semiconductor process, miniaturization of a transfer pattern in photolithography of a semiconductor process has been developed rapidly. In the next generation, fine processing of 20 nm or smaller will be demanded. As such, it is expected to develop an exposure device by combining an extreme ultraviolet (EUV) light generation device that generates extreme ultraviolet (EUV) light having a wavelength of about 13 nm and reduced projection reflective optics.

As EUV light generation devices, three types of devices are proposed, namely an LPP (Laser Produced. Plasma) type device using plasma generated by radiating laser light to a target material, a DPP (Discharge Produced Plasma) type device using plasma generated by electric discharge, and an SR (Synchrotron Radiation) type device using orbital radiation light.

CITATION LIST

Patent Literature

Patent Literature 1: Japanese Patent Application Laid-Open No. 2014-102981

Patent Literature 2: Japanese Patent Application Laid-Open No. 2014-068862

SUMMARY

An extreme ultraviolet light generation device according to one aspect of the present disclosure may include a chamber, and a target supply unit. In the chamber, a target may be irradiated with laser light, and extreme ultraviolet light may be generated. The target supply unit may be configured to eject a target into the chamber. The target supply unit may be provided with a nozzle member including an ejection face having an ejection port configured to eject the target into the chamber. An angle θ1 defined by the ejection face and a gravity axis may satisfy a condition of "0 degrees<θ1<90 degrees".

BRIEF DESCRIPTION OF THE DRAWINGS

Some embodiments of the present disclosure will be described below as just examples with reference to the accompanying drawings.

FIG. 13 illustrates exemplary materials of a nozzle member of a ninth embodiment.

EMBODIMENTS

Figure 1:
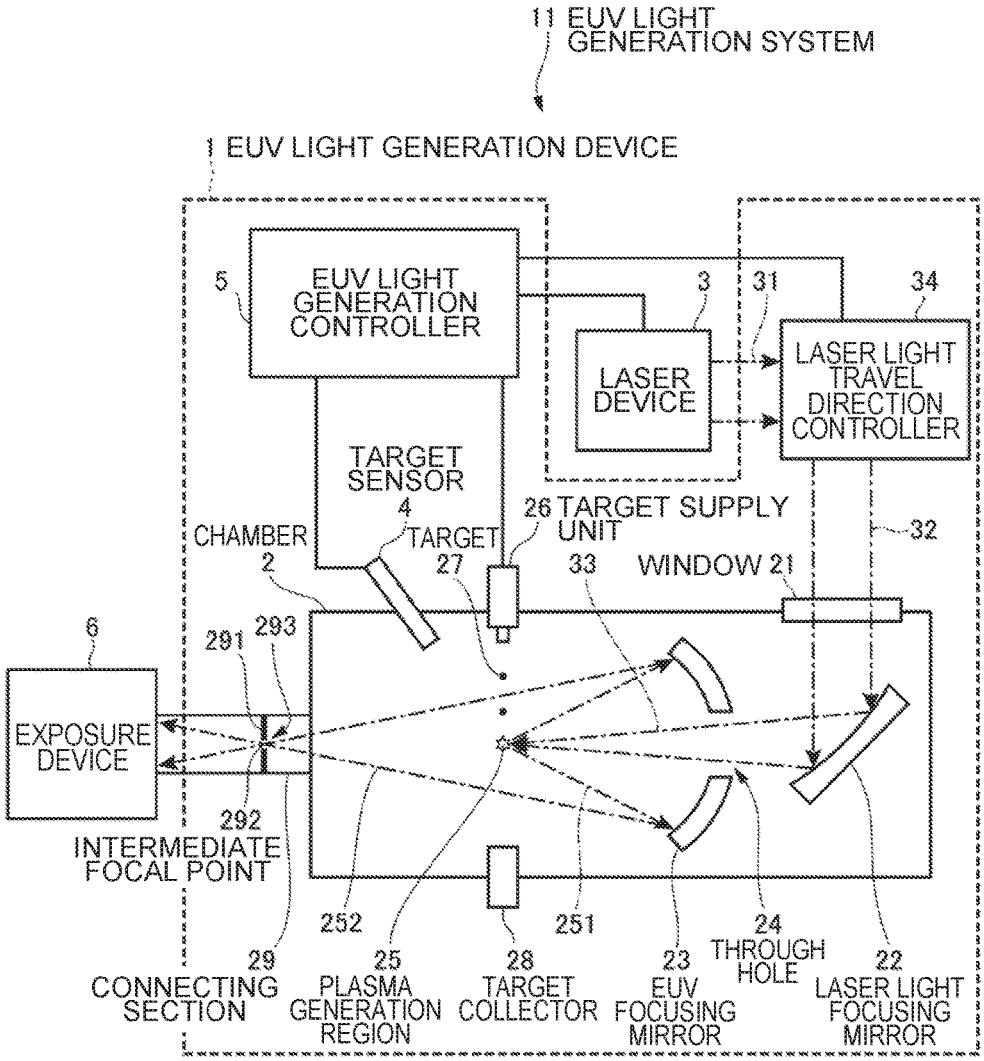
FIG. 1 illustrates an exemplary schematic configuration of an EUV light generation system.

Hereinafter, embodiments of the present disclosure will be described in detail with reference to the drawings.

The embodiments described below illustrate some examples of the present disclosure, and do not limit the contents of the present disclosure. All of the configurations and the operations described in the embodiments are not always indispensable as configurations and operations of the present disclosure, It should be noted that the same constituent elements are denoted by the same reference numerals, and redundant description is omitted.

1. Overall description of EUV light generation system
1.1 Configuration
1.2 Operation
2. Terms
3. Problem
3.1 Basic configuration of EUV light generation device including target generation device
3.2 Operation of EUV light generation device including target generation device
3.3 Configuration of comparative system
3.4 Operation of comparative system
3.5 Problem
4. First embodiment
4.1 Configuration
4.2 Operation
4.3 Effect
5. Second embodiment
5.1 Configuration
5.2 Operation
5.3 Effect
6. Third embodiment
6.1 Configuration
6.2 Operation
6.3 Effect
7. Fourth embodiment
7.1 Configuration
7.2 Operation
7.3 Effect 8. Fifth embodiment
8.1 Configuration
8.2 Operation
8.3 Effect
9. Sixth embodiment
9.1 Configuration
9.2 Operation
9.3 Effect
10. Seventh embodiment
10.1 Configuration
10.2 Operation
10.3 Effect
11. Eighth embodiment
11.1 Configuration
11.2 Operation
11.3 Effect
12. Ninth embodiment
12.1 Configuration
12.2 Operation
12.3 Effect
13. Tenth embodiment
13.1 Configuration
13.2 Operation
13.3 Effect

[1. Overall Description of EUV Light Generation System]

[1.1 Configuration]

FIG. 1 schematically illustrates a configuration of an exemplary LPP type EUV light generation system.

An EUV light generation device 1 may be used together with at least one laser device 3, in the present application, a system including the EUV light generation device 1 and the laser device 3 is called an EUV light generation system 11.

As illustrated in FIG. 1 and described below in detail, the EUV light generation device 1 may include a chamber 2 and a target supply unit 26. The chamber 2 may be sealable. The target supply unit 26 may be provided so as to penetrate a wall of the chamber 2. The material of a target substance supplied from the target supply unit 26 may include, but not limited to, tin, terbium, gadolinium, lithium, xenon, or a combination of any two or more of them.

A wall of the chamber 2 may be provided with at least one through hole. The through hole may have a window 21. Pulse laser light 32 output from the laser device 3 may penetrate the window 21. Inside the chamber 2, an EUV focusing mirror 23 having a spheroidal reflection surface, for example, may be disposed. The EUV focusing mirror 23 may have first and second focuses. On the surface of the EUV focusing mirror 23, a multilayer reflection film in which molybdenum and silicon are alternately layered, for example, may be formed. It is preferable that the EUV focusing mirror 23 is disposed such that the first focus locates in a plasma generation region 25 and the second focus locates at an intermediate focal point (IF) 292, for example. The EUV focusing mirror 23 may have a through hole 24 in the center portion thereof, and pulse laser light 33 may pass through the through hole 24.

The EUV light generation device 1 may include an EUV light generation controller 5, a target sensor 4, and the like. The target sensor 4 may have an image capturing function, and may be configured to detect presence, trajectory, position, velocity, and the like of the target 27.

The EUV light generation device 1 may also include a connecting section 29 configured to communicate the inside of the chamber 2 and the inside of an exposure device 6 with each other. In the connecting section 29, a wall 291 having an aperture 293 may be provided. The wall 291 may be disposed such that the aperture 293 locates at the second focus position of the EUV focusing mirror 23.

Moreover, the EUV light generation device I may also include a laser light travel direction controller 34, a laser light focusing mirror 22, a target collector 28 configured to collect the target 27, and the like. The laser light travel direction controller 34 may have an optical element for defining the travel direction of the laser light, and an actuator for regulating the position, posture, and the like of the optical element.

[1.2 Operation]

Referring to FIG. 1, pulse laser light 31 output from the laser device 3 may pass through the laser light travel direction controller 34 and penetrate the window 21 as the pulse laser light 32 to enter the chamber 2. The pulse laser light 32 may travel inside the chamber 2 along at least one laser light path, and may be reflected by the laser light focusing mirror 22 and radiated as the pulse laser light 33 to at least one target 27.

The target supply unit 26 may be configured to output the target 27 toward the plasma generation region 25 in the chamber 2. The target 27 may be irradiated with at least one pulse included in the pulse laser light 33. The target 27 irradiated with the pulse laser light is made into plasma, and from the plasma, EUV light 251 may be radiated along with radiation of light having another wavelength. The EUV light 251 may be reflected selectively by the EUV focusing mirror 23. EUV light 252 reflected by the EUV focusing mirror 23 may be focused at the intermediate focal point 292 and output to the exposure device 6. One target 27 may be irradiated with a plurality of pulses included in the pulse laser light 33.

The EUV light generation controller 5 may be configured to integrate the control of the entire EUV light generation system 11. The EUV light generation controller 5 may be configured to process image data or the like of the target 27 captured by the target sensor 4. Further, the RN light generation controller 5 may perform at least one of control of timing when the target 27 is output and control of output direction or the like of the target 27, for example. Furthermore, the EUV light generation controller 5 may perform at least one of control of oscillation timing of the laser device 3, control of the travel direction of the pulse laser light 32, and control of the light focusing position of the pulse laser light 33, for example. The various types of control described above are just examples, and another type of control may be added when necessary.

[2. Terms]

"Target" means an object to be irradiated with laser light introduced to the chamber. A target irradiated with laser light may be made into plasma and radiate EUV light.

"Droplet" is a mode of a target fed to the chamber.

[3. Problem]

[3.1 Basic Configuration of EUV Light Generation Device Including Target Generation Device]

Figure 2:
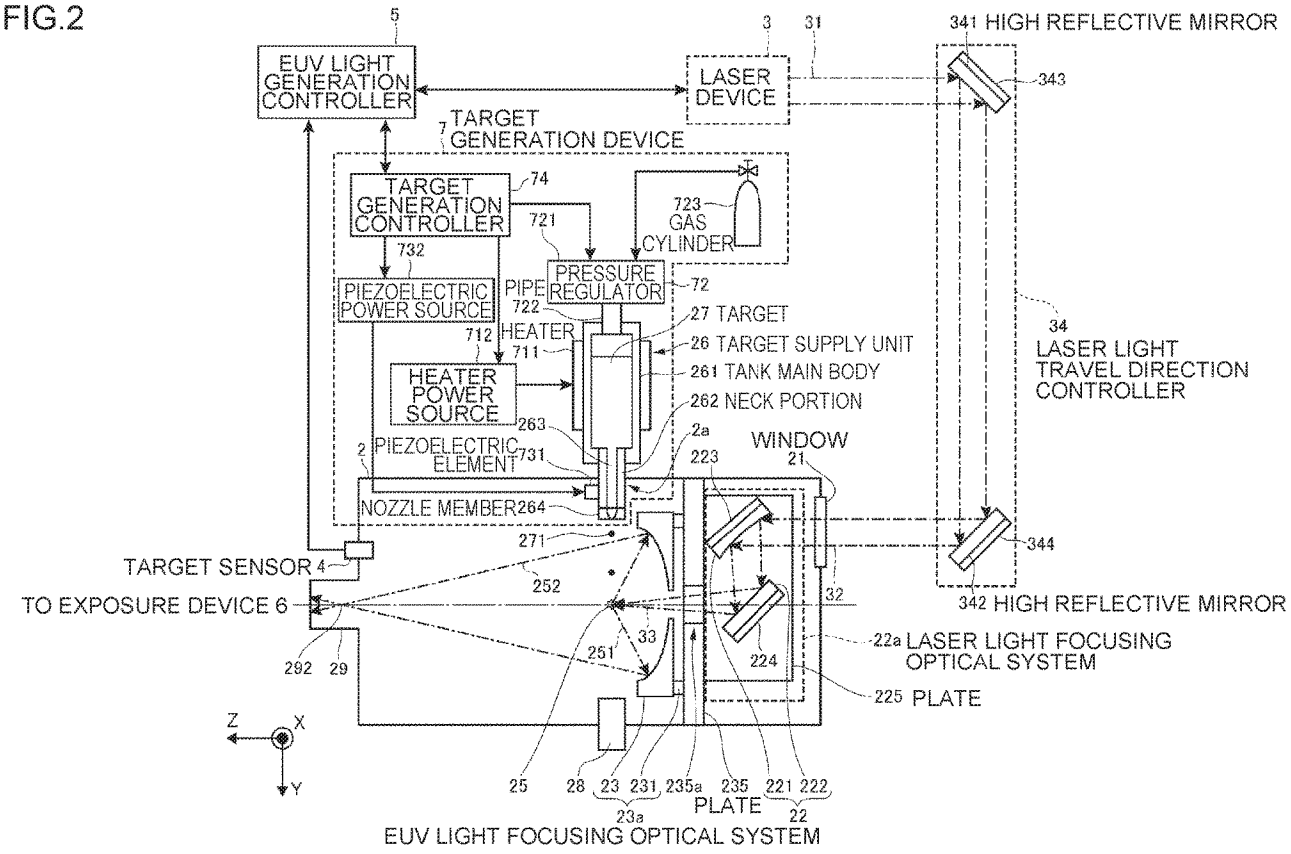
FIG. 2 illustrates an exemplary schematic configuration of an EUV light generation device including a target generation device.
Figure 3:
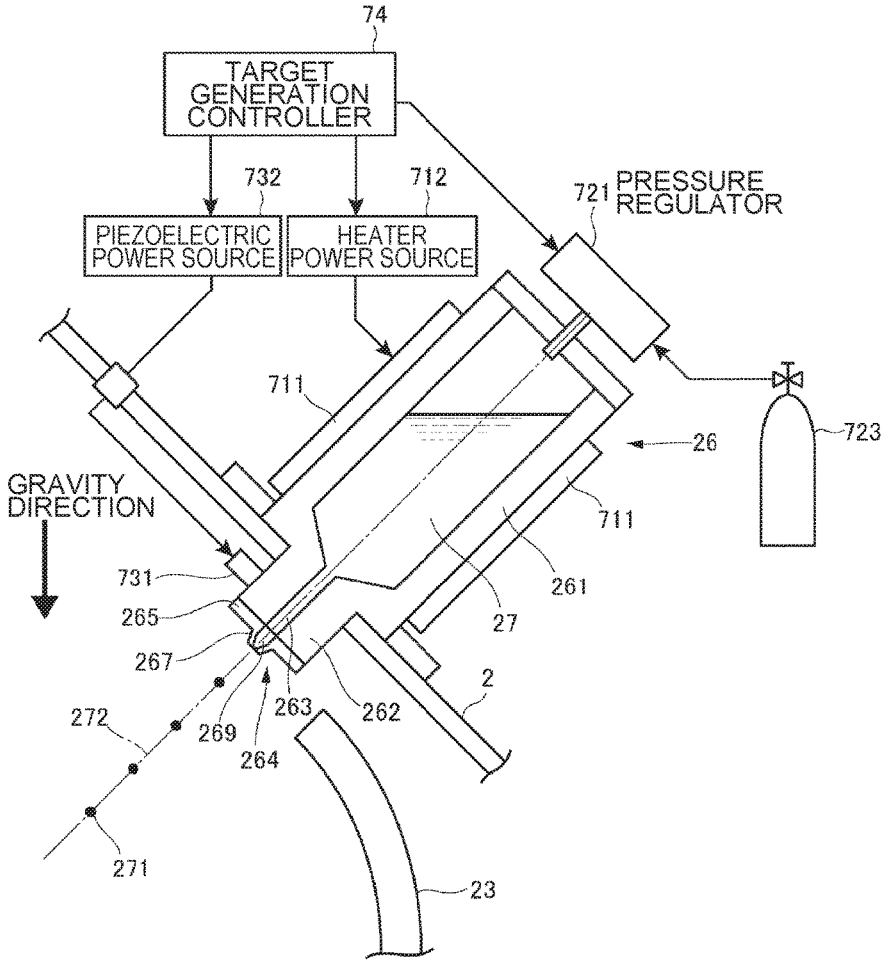
FIG. 3 illustrates a target generation device using a nozzle member, and a target supply state.

FIGS. 2 and 3 illustrate a main configuration of the EUV light generation device 1 including the target generation device 7.

In FIG. 2, a direction deriving the EUV light 252 from the chamber 2 of the EUV light generation device 1 toward the exposure device 6 may be a Z axis, An X axis and a Y axis may be axes orthogonal to the Z axis and orthogonal to each other. The coordinate axes may be used based on FIG. 2 in the subsequent drawings.

The EUV light generation device 1 may include the chamber 2, the target generation device 7, the EUV light generation controller 5, the laser light travel direction controller 34, and the target collector 28. The target generation device 7 may output the target 27 into the chamber 2 as a droplet 271 to thereby supply the target 27 into the chamber 2. In the drawing, the laser device 3 is also illustrated as a configuration of the EUV light generation system 11.

The chamber 2 may separate the internal space to be decompressed for generating EUV light, from an externality. The outer shape of the chamber 2 may be formed to be a hollow spherical shape, or a hollow cylindrical shape as illustrated in FIG. 2, for example. The center axial direction of the chamber 2 having a hollow cylindrical outer shape may be a direction along the direction of outputting the EUV light 252 to the exposure device 6.

In the cylinder side face portion of the hollow chamber 2, a target supply hole 2*a* may be formed. When the chamber 2 is in a hollow spherical shape, the target supply hole 2*a* may be formed at a position in a wall portion of the chamber 2 and not provided with a window 21 and a connecting section 29. In the target supply hole 2*a,* a tank main body 261 that is a part of the target generation device 7 may be inserted.

The internal space of the chamber 2 may be divided by a plate 235. The plate 235 may be fixed on the inner face of the chamber 2. The center of the plate 235 may have a hole 235*a* through which pulse laser light 33 can pass in the thickness direction thereof. The opening direction of the hole 235*a* may be the same direction as the axis passing through the through hole 24 and the plasma generation region 25 in FIG. 1.

A section on the window 21 side, divided by the plate 235, may be provided with a laser light focusing optical system 22*a,* The laser light focusing optical system 22*a* may include an off-axis parabolic mirror 221, and a plane mirror 222. The off-axis parabolic mirror 221 may be positioned, by a holder 223, at a location where it can be seen through from the window 21. The plane mirror 222 may be positioned, by a holder 224, at a location facing the off-axis parabolic mirror 221, the location being able to be seen through the hole 235*a* of the plate 235. The holder 223 and the holder 224 may be fixed to a plate 225. The plate 225 may be provided to one face of the plate 235 via a triaxial stage not illustrated. In that case, the position and the posture of the plate 225 may be adjusted by the triaxial stage. The positions and the posture of the off-axis parabolic mirror 221 and the plane mirror 222 can be regulated along with a change in the position and the posture of the plate 225. The regulation can be executed such that the pulse laser light 33, that is reflective light of the pulse laser light 32 made incident on the off-axis parabolic mirror 221 and the plane mirror 222, is focused on the plasma generation region 25.

A section on the connecting section 29 side, divided by the plate 235, may be provided with an EUV light focusing optical system 23*a.* The EUV light focusing optical system 23*a* may include an EUV focusing mirror 23 and a holder 231. The holder 231 may hold the EUV focusing mirror 23. The holder 231 may be fixed to the plate 235. The through hole 24 provided in a center portion of the EUV focusing mirror 23 may overlap the hole 235*a* of the plate 235.

The section on the connecting section 29 side may also be provided with the target collector 28. The target collector 28 may collect the target 27 ejected into the chamber 2. The target collector 28 may be provided at a position facing the target supply hole 2*a* in the chamber 2. The target collector 28 may be disposed on the extended line of a target travel path 272 that is a travel path of the target 27 output as the droplet 271 into the chamber 2.

The laser device 3 may generate and output pulse laser light 31.

The laser light travel direction controller 34 may guide the pulse laser light 31 to the chamber 2. The laser light travel direction controller 34 may include a high reflective mirror 341 and a high reflective mirror 342. The high reflective mirror 341 may be positioned, by a holder 343, at a location facing the emission port of the laser device 3 from which the pulse laser light 31 is emitted. The high reflective mirror 342 may be positioned, by a holder 344, at a location facing the high reflective mirror 341 and being able to be seen through from the window 21 of the chamber 2. The positions and the posture of the holder 343 and the holder 344 may be changeable by an actuator, not illustrated, connected with the EUV light generation controller 5. The positions and the posture of the high reflective mirror 341 and the high reflective mirror 342 can be regulated along with a change in the positions and the posture of the holder 343 and the holder 344 by the EUV light generation controller 5. The regulation can be executed such that the pulse laser light 32, that is reflective light of the pulse laser light 31 and is made incident on the high reflective mirror 341 and the high reflective mirror 342, penetrates the window 21 provided on the bottom face of the chamber 2.

The EUV light generation controller 5 may control generation of the EUV light 252 by the EUV light generation device 1. The EUV light generation controller 5 may be communicably connected with the laser device 3 and a target generation controller 74, described below, of the target generation device 7, and may output a control signal to them. The EUV light generation controller 5 may match the timing when the droplet 271 as the target 27 reaches the plasma generation region 25 and the timing when the pulse laser light 31 generated by the laser device 3 reaches the plasma generation region 25. Thereby, the EUV light generation controller 5 can be controlled such that the droplet 271 is irradiated with the pulse laser light 31 in the plasma generation region 25.

The EUV light generation controller 5 may also be connected with the laser light travel direction controller 34 and the laser light focusing optical system 22*a,* and may transmit and receive control signals with the actuators of them and a triaxial stage. Thereby, the FUN light generation controller 5 can regulate the travel direction and the light focusing position of the pulse laser light 31 to 33.

The target generation device 7 may output the droplet 271 into the chamber 2 to thereby supply the target 27 into the chamber 2. The target generation device 7 may include a target supply unit 26, a pressure regulator 721, a gas cylinder 723, a piezoelectric power source 732, a heater power source 712, and the target generation controller 74.

The target supply unit 26 may include the tank main body 261, a piezoelectric element 731, a heater 711, a nozzle member 264, and a pipe 722.

The tank main body 261 may be formed to have a hollow cylindrical outer shape. The tank main body 261 having a cylindrical outer shape may store the target 27 therein. One end face of the tank main body 261 having a cylindrical outer shape may have a neck portion 262. The neck portion 262 may have a cylindrical outer shape narrower than the tank main body 261, for example. To the tip of the cylindrical neck portion 262, the nozzle member 264 may be fixed. The nozzle member 264 may have a disk-shaped substrate portion 265, for example. The nozzle member 264 may be screwed to the neck portion 262 with screws at a plurality of positions along the outer periphery of the disk-shaped substrate portion 265. The center of the disk-shaped nozzle member 264 may have a perforated ejection hole 269. The tank main body 261 and the neck portion 262 may have a supply path 263 configured to guide the target 27 to the ejection hole 269.

The tank main body 261 may be made of a material that resists chemical reaction with the target 27. The tank main body 261 may be configured such that at least the inner face to be in contact with the target 27 is made of a material that resists chemical reaction with the target 27. A material that resists chemical reaction with the target 27 may be any of silicon carbide, silicon oxide, aluminum oxide, molybdenum, tungsten, and tantalum, for example.

As illustrated in FIG. 3, the tank main body 261 may be mounted to penetrate a cylinder side face portion 282*a* of the hollow chamber 2 in a state where the neck portion 262 is inserted in the target supply hole 2*a*. 1n this state, the surface of the nozzle member 264 may be exposed to the inside of the chamber 2. The target supply hole 2*a* may be closed when the tank main body 261 is mounted. The inside of the chamber 2 may be isolated from the outside air. On the extended line in the axial direction of the ejection hole 269 at the center of the nozzle member 264, the plasma generation region 25 and the target collector 28, provided in the chamber 2, may be positioned. The inside of the tank main body 261 for storing the target 27 and the inside of the chamber 2 may communicate with each other via the ejection hole 269.

The heater 711 may heat and melt the target 27 stored in the tank main body 261. The heater 711 may be fixed around the outer peripheral face along the outer peripheral face of the tank main body 261 having a cylindrical outer shape. In that case, the tank main body 261 and the neck portion 262 may be made of a metallic material having high heat conductivity. The heater 711 may be connected with the heater power source 712. The heater 711 may generate heat when energized by the heater power source 712.

The heater power source 712 may supply electric power to the heater 711. The heater power source 712 may be connected with the target generation controller 74. Energization to the heater 711 by the heater power source 712 may be controlled by the target generation controller 74.

To the tank main body 261, a temperature sensor, not illustrated, may be fixed. The temperature sensor may be connected with the target generation controller 74. The temperature sensor may detect the temperature of the tank main body 261 or the temperature of the target 27 stored in the tank main body 261. The temperature sensor may output a detected value of the temperature to the target generation controller 74. The target generation controller 74 may control energization to the heater 711 such that the temperature of the tank main body 261 or the temperature of the target 27 stored in the tank main body 261 is maintained at temperature equal to or higher than the temperature at which the target 27 melts, based on the value detected by the temperature sensor. Thereby, the temperature of the tank main body 261 or the temperature of the target 27 stored in the tank main body 261 can be regulated to be target temperature at which a state where the target 27 is molten is maintained.

The gas cylinder 723 may be filled with fluid for pressurizing the target 27 stored in the tank main body 261. The fluid may be inert gas such as helium, argon, or the like. The tank main body 261 and the neck portion 262 may be formed in a cylindrical shape so as to achieve high pressure resistance.

The gas cylinder 723 may be linked to the pressure regulator 721. The inert gas in the gas cylinder 723 may be provided to the pressure regulator 721.

The pressure regulator 721 may be linked to the tank main body 261 via the pipe 722. The pressure regulator 721 may be linked to the tank main body 261 at a portion, protruded to the outside of the chamber 2, of the tank main body 261. The pressure regulator 721 may supply the inert gas in the gas cylinder 723 to the inside of the tank main body 261 storing the target 27, via the pipe 722. The pipe 722 may be covered with a heat insulating member or the like not illustrated. The pipe 722 may be provided with a heater not illustrated. The temperature in the pipe 722 may be maintained at temperature similar to the temperature in the tank main body 261 of the target supply unit 26.

The pressure regulator 721 may include an electromagnetic valve for air supply and exhaust, a pressure sensor, and the like therein. The pressure regulator 721 may detect pressure inside the tank main body 261 with use of a pressure sensor. The pressure regulator 721 may be linked to an exhaust pump not illustrated. The pressure regulator 721 may operate the exhaust pump to exhaust gas in the tank main body 261. The pressure regulator 721 can increase or decrease the pressure in the tank main body 261 by supplying gas to the tank main body 261 or exhausting gas in the tank main body 261.

The pressure regulator 721 may be connected with the target generation controller 74. The pressure regulator 721 may output a detection signal of the detected pressure to the target generation controller 74. To the pressure regulator 721, a control signal for a target pressure, output from the target generation controller 74, may be input. The pressure regulator 721 may supply gas to the tank main body 261 and exhaust gas in the tank main body 261 such that a detection value of the pressure in the tank main body 261, detected by the pressure sensor, becomes a target pressure. Thereby, the pressure in the tank main body 261 can be regulated to the target pressure.

With the pressure applied to the inside of the tank main body 261, molten target 27 stored in the tank main body 261 may be ejected from the ejection hole 269 of the nozzle member 264. Thereby, the molten target 27 can be ejected from the ejection hole 269 in the form of jet.

The piezoelectric element 731 may vibrate the neck portion 262 of the tank main body 261. The piezoelectric element 731 may be mounted on the outer peripheral face of the neck portion 262 protruding to the inside of the chamber 2.

The piezoelectric power source 732 may be electrically connected with the piezoelectric element 731. The piezoelectric power source 732 may supply electric power to the piezoelectric element 731. The piezoelectric power source 732 may also be connected with the target generation controller 74. To the piezoelectric power source 732, a control signal output from the target generation controller 74 may be input. A control signal output from the target generation controller 74 may be a control signal for supplying electric power to the piezoelectric element 731 in a predetermined waveform by the piezoelectric power source 732.

The piezoelectric power source 732 may supply electric power to the piezoelectric element 731 based on the control signal of the target generation controller 74. The piezoelectric element 731 may vibrate the nozzle member 264 according to a predetermined waveform. Thereby, vibration in a standing waveform may be applied to the flow of the target 27 ejected from the nozzle member 264 in the form of jet.

With the vibration, the target 27 may be separated cyclically. The separated target 27 may form a free interface by the own surface tension to thereby form the droplet 271.

The target generation controller 74 may transmit and receive a control signal to and from the EUV light generation controller 5, and collectively control the entire target generation device 7. The target generation controller 74 may output a control signal to the heater power source 712, and control the operation of the heater 711 via the heater power source 712. The target generation controller 74 may output a control signal to the pressure regulator 721, and control the operation of the pressure regulator 721. The target generation controller 74 may output a control signal to the piezoelectric power source 732, and control the operation of the piezoelectric element 731 via the piezoelectric power source 732.

[3.2 Operation of EUV Light Generation Device Including Target Generation Device]

In order to generate the EUV light 252, the target generation controller 74 may collectively control the operation of the entire target generation device 7.

The target generation controller 74 may output a control signal to the heater power source 712, and heat the target 27 stored in the tank main body 261. Thereby, the target 27 can melt. The target generation controller 74 may output a control signal to the pressure regulator 721 and the piezoelectric power source 732. Thereby, the molten target 27 can be ejected from the ejection hole 269 into the chamber 2 by the applied pressure. Further, the ejected target 27 can become the droplet 271 by the vibration, and move in the chamber 2. In the chamber 2, a plurality of droplets 271 may continuously move discretely. Further, the target generation controller 74 may detect the droplet 271 by the target sensor 4 as required, and regulate the pressure by the pressure regulator 721, for example. Thereby, the droplet 271 can pass through the plasma generation region 25.

On the other hand, the EUV light generation controller 5 may activate the laser device 3 and output the pulse laser light 31 The pulse laser light 31 output from the laser device 3 can become the pulse laser light 32 that is supplied to the chamber 2 via the laser light travel direction controller 34. The pulse laser light 32 may enter the chamber 2 from the window 21. The pulse laser light 32 that entered the chamber 2 can become the pulse laser light 33 focused by the laser light focusing optical system 22*a*. The EUV light generation controller 5 may also regulate the laser light focusing optical system 22*a* as required. Thereby, the pulse laser light 33 can be focused in the plasma generation region 25.

Then, the EUV light generation controller 5 may perform timing control such that the droplet 271 and the pulse laser light 33 reach the plasma generation region 25 simultaneously. The target generation controller 74 may regulate the output timing of the pulse laser light 33 from the laser device 3 based on an output signal from the target sensor 4, for example. Thereby, the pulse laser light 33 can reach the plasma generation region 25 at the timing that the droplet 271 passes through the plasma generation region 25.

Then, when they reach the plasma generation region 25 simultaneously, the target 27 irradiated with the pulse laser light 33 can be made into plasma. The EUV light 251 can be radiated from the plasma. The EUV light 251 may be selectively reflected by the EUV focusing mirror 23. The EUV light 252 reflected by the EUV focusing mirror 23 may be focused at an intermediate focal point 292, and output to the exposure device 6. One droplet 271 may be irradiated with a plurality of units of pulse laser light 33 continuously.

[3.3 Configuration of Comparative System]

Figure 4:
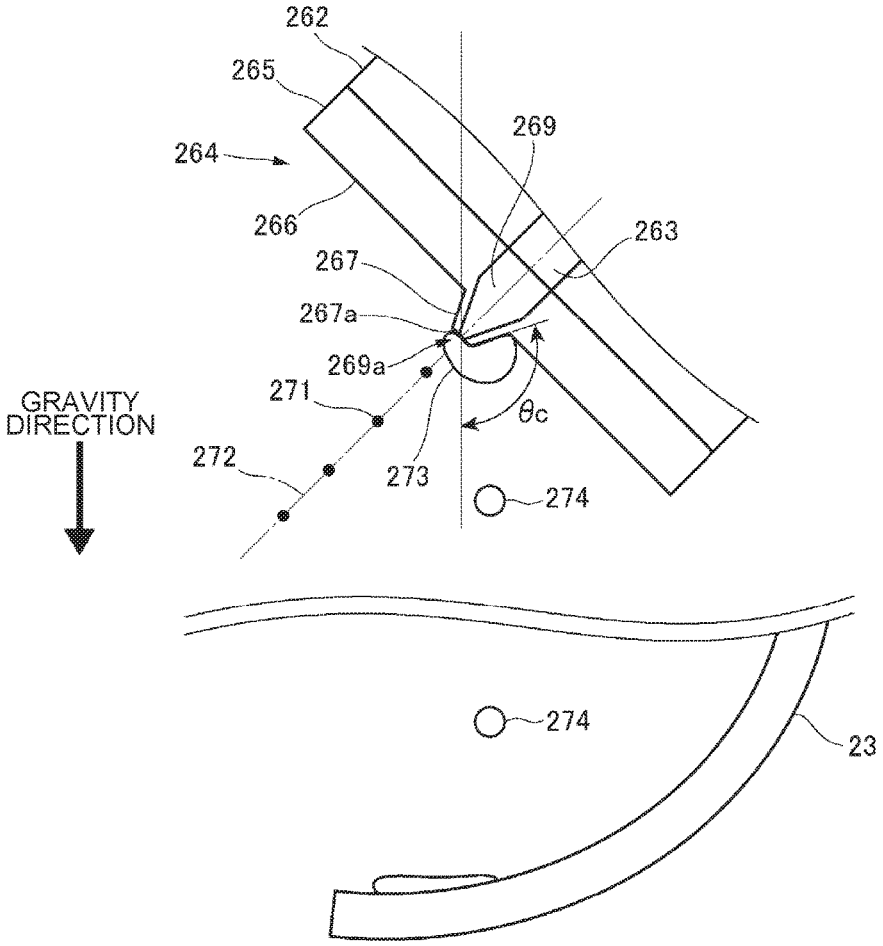
FIG. 4 illustrates a nozzle member and a target ejecting state of a comparative example.

FIG. 4 illustrates the nozzle member 264 and a state of ejecting the target 27 of a comparative example. In FIG. 4, the up and down direction of the sheet may be the gravity direction.

The target supply unit 26 may be disposed such that the target travel path 272 has an angle larger than 0 degrees with respect to the downward direction of the gravity axis.

The nozzle member 264 of the comparative example may include the substrate portion 265, a protruding portion 267, and the ejection hole 269.

The substrate portion 265 may have a planar disk shape. The center axis of the disk-shaped substrate portion 265 may be in parallel with the target travel path 272. The substrate portion 265 may be fixed in an exchangeable manner at the tip of the neck portion 262 of the tank main body 261. The substrate portion 265 may have a base face 266 exposed to the inside of chamber 2.

The protruding portion 267 may have a truncated cone shape symmetrical with the center axis. The truncated cone-shaped protruding portion 267 may be formed at the center of the disk-shaped substrate portion 265 coaxially with the substrate portion 265. The center axis of the protruding portion 267 may be in parallel with the target travel path 272.

The ejection hole 269 may penetrate the protruding portion 267 and the substrate portion 265 so as to extend along the center axis of the truncated cone-shaped protruding portion 267 and the disk-shaped substrate portion 265.

The tip of the truncated cone-shaped protruding portion 267 may have an ejection port 269*a* that is an end portion of the ejection hole 269. The ejection port 269*a* may be in a circular shape. The center axis running through the center of the ejection port 269*a* may be the same as the center axis of the nozzle member 264. The center axis of the nozzle member 264 may be in parallel with the center axis of the ejection hole 269. The face between the ejection port 269*a* and the peripheral face of the truncated cone-shaped protruding portion 267 may be an ejection face 267*a*.

As illustrated in FIG. 4, the center axis of the nozzle member 264 may be provided to be inclined against the gravity direction. In that case, the target travel path 272 can be provided to be inclined against the gravity direction obliquely downward.

As illustrated in FIG. 4, the peripheral face of the truncated cone-shaped protruding portion 267 is formed such that the lower portion in the gravity direction is formed obliquely upward above the horizontal surface on the basis of a lower end of the ejection face 267*a*. This means that in FIG. 4, the peripheral face of the protruding portion 267 may be inclined such that an angle $\theta c$ defined by the lower portion in the gravity direction and the gravity axis downward direction satisfies a condition of "90 degrees<θc".

[3.4 Operation of Comparative System]

In the case of ejecting the target 27 from the nozzle member 264 as illustrated in FIG. 4, the heater power source 712 may heat the tank main body 261 by the heater 711. The target 27 in the tank main body 261 may be heated to temperature equal to or higher than the melting point.

Further, the pressure regulator 721 may supply gas in the gas cylinder 723 to the tank main body 261. The target 27 in the tank main body 261 may be pressurized to a predetermined pressure according to the gas supply amount. The molten target 27 can be started to be ejected from the ejection port 269*a* of the nozzle member 264. The predetermined pressure may be several tens MPa, for example. When being pressurized up to the predetermined pressure, the molten target 27 can be ejected into the chamber 2 along the target travel path 272. The target 27 can be ejected from the ejection port 269*a* of the nozzle member 264 provided in a posture inclined against the gravity direction while facing obliquely downward, and can travel obliquely downward.

Further, the piezoelectric power source 732 may vibrate, in a constant cycle, the neck portion 262 of the tank main body 261. Thereby, the neck portion 262 vibrates, and the target 27 ejected from the ejection port 269*a* of the nozzle member 264 can be separated according to the cycle. The target 27 ejected into the chamber 2 along the target travel path 272 can become a plurality of droplets 271 continuously traveling with certain intervals.

In the case of stopping ejecting of the target 27 from the nozzle member 264, the piezoelectric power source 732 may stop vibrating the neck portion 262 of the tank main body 261. The pressure regulator 721 may release the gas from the tank main body 261. The pressure of the target 27 in the tank main body 261 may be gradually reduced, and finally reduced to be the same pressure as that in the chamber 2, for example. Thereby, ejecting of the target 27 from the ejection port 269*a* of the nozzle member 264 is stopped.

[3.5 Problem]

Meanwhile, in the case of providing the center axis of the nozzle member 264 to be inclined against the gravity direction to eject the target 27 from the ejection hole 269 as described above, there is a case where the target 27 does not travel properly. This means that the target 27 may not travel inside the chamber 2 along the target travel path 272, and may adhere to the surface of the nozzle member 264 around the ejection port 269*a*. For example, after the target 27 stored in the tank main body 261 is melted, in a. pressurization period from the time when pressurization started until completion of the pressurization up to a predetermined pressure, for example, the target 27 may adhere to the surface of the nozzle member 264 around the ejection port 269*a*. Further, even in an ending period from the time when decompression begins until the time when ejecting of the target 27 from the ejection hole 269 stops, the target 27 may adhere to the surface of the nozzle member 264 around the ejection port 269*a*.

As described above, as the target 27 ejected in the pressurization period and the decompression period is not pressurized at a predetermined pressure, the kinetic energy is in short. Accordingly, after being ejected from the ejection hole 269, the target 27 may adhere to the surface of the nozzle member 264 around the ejection port 269*a*. The target 27 adhering to the surface of the nozzle member 264 may become an adhering target 273. In particular, as illustrated in the comparative example of FIG. 4, in the case where the lower portion in the gravity direction of the peripheral surface of the protruding portion 267 is inclined upward from the horizontal face, the target 27 ejected from the ejection hole 269 may adhere so as to remain on the surface of the nozzle member 264 around the ejection port 269*a*.

Further, in a state where there is the adhering target 273 on the surface of the nozzle member 264 around the ejection port 269*a* as described above, when the subsequent target 27 is ejected, the subsequent target 27 may be in contact with the adhering target 273.

As a result, in the case where the subsequent target 27 is ejected while the adhering target 273 still adheres around the ejection port 269*a*, the ejecting direction of the subsequent target 27 may easily be changed to a direction deviated from the target travel path 272. Further, the kinetic energy of the subsequent target 27 may be reduced by being brought into contact with the adhering target 273 around the ejection port 269*a*. Thereby, the trajectory of the droplet 271 may be deviated from the target travel path 272. and deteriorate. Further, the subsequent target 27 may easily adhere to the surface of the nozzle member 264 around the ejection port 269*a*. In that case, generation of the droplet 271 may be difficult. Further, the adhering amount of the target 27 may be increased around the ejection port 269*a*. The adhering target 273 may grow bigger around the ejection port 269*a*. The grown target 27 may drop from the lower end of the ejection face 267*a* into the chamber 2. The target 27 dropped from the lower end of the ejection face 267*a* into the chamber 2 may be a dropped target 274.

Further, the target 27 ejected out of the target travel path 272 may not be collected by the target collector 28 and may pollute the inside of the chamber 2. In particular, when the EUV focusing mirror 23 is disposed below the nozzle member 264, the target 27 travelling on a deviated trajectory may adhere to the surface of the EUV focusing mirror 23.

In the case where the target 27 adheres around the ejection port 269*a* as described above, a maintenance work for removing the target 27 may be required. Further, when the target 27 adheres to the surface of the EUV focusing mirror 23, a maintenance work for removing the target 27 may be required. Such a maintenance work may lower the operation rate of the EUV light generation system 11.

[4. First Embodiment]

[4.1 Configuration]

Figure 5:
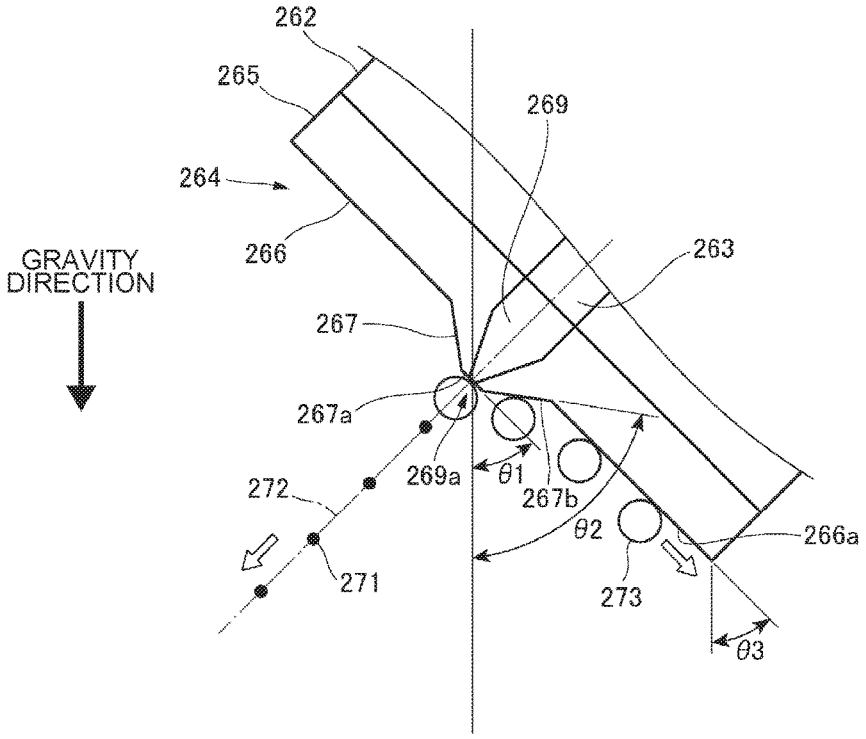
FIG. 5 illustrates a nozzle member and a target ejecting state of a first embodiment.

FIG. 5 illustrates the nozzle member 264 and a state of ejecting the target 27 of a first embodiment. In FIG. 5, the up and down direction of the sheet may be the gravity direction.

The nozzle member 264 of the first embodiment may include the substrate portion 265, the protruding portion 267, the ejection hole 269, the ejection face 267*a*, a first flow path 267*b*, and a second flow path 266*a*.

The ejection hole 269 may be the same as that of the comparative example.

The ejection face 267*a* may be formed at the tip of the truncated cone-shaped protruding portion 267. The ejection face 267*a* may be formed in a circular shape so as to be almost in parallel with the base face 266 of the disk-shaped substrate portion 265. The center of the ejection face 267*a* may have the ejection port 269*a* as an end portion of the ejection hole 269. In that case, the center of the ejection hole 269 and the center of the ejection face 267*a* may coincide with each other. Further, the ejection face 267*a* may be formed around the ejection port 269*a*.

The ejection face 267*a* may be inclined such that the angle θ1 with the gravity axis satisfies a condition of "0 degrees<θ1<90 degrees". More preferably, it may be inclined to satisfy a condition of "10 degrees<θ1<80 degrees". Further, the ejection face 267*a* may be inclined such that the angle defined by the ejection face 267*a* and the gravity axis is equal to the angle defined by the outside plane of the disk-shaped substrate portion 265 and the gravity axis.

The first flow path 267*b* may be formed as a part of the truncated cone-shaped peripheral face of the protruding portion 267. The first flow path 267*b* may be formed as a lower portion in the gravity direction of the truncated cone-shaped peripheral face. The first flow path 267*b* may be formed as a surface from the lower end in the gravity direction of the ejection face 267*a* to the base face 266 of the substrate portion 265.

The first flow path 267*b* may be inclined such that an angle θ2 defined with the gravity axis satisfies a condition of "0 degrees<θ2<90 degrees". More preferably, the first flow path 267*b* may be inclined to satisfy a condition of "10 degrees<θ2<80 degrees". Further, the first flow path 267*b* may be inclined to satisfy a condition of "θ1<θ2<90 degrees".

The second flow path 266*a* may be formed as a part of the base face 266. The second flow path 266*a* may be formed as a lower portion in the gravity direction, which is a part below the protruding portion 267 in the base face 266. The second flow path 266*a* may be formed as a surface from a portion where the truncated cone-shaped peripheral face of the protruding portion 267 is connected with the base face 266 to the lower end in the gravity direction of the base face 266.

The second flow path 266*a* may be inclined such that an angle θ3 defined with the gravity axis satisfies a condition of "0 degrees<θ3<90 degrees ". Preferably, the second flow path 266*a* may be inclined to satisfy a condition of "10 degrees<θ3<80 degrees". Further, the second flow path 266*a* may be inclined to satisfy a condition of "0 degrees<θ3<θ2".

When the target 27 to be melted is tin, the nozzle member 264 may be made of molybdenum or tungsten, for example, while the material thereof will be described below.

The surface roughness of the surface of the nozzle member 264 may be formed such that a maximum height in a surface portion of a reference length is 0.2 S or larger but 0.3 S or smaller, and the ten-point average roughness of the surface portion of the reference length may be about Rz=0.2.

[4.2 Operation]

As illustrated in FIG. 5, when the center axis of the nozzle member 264 is disposed to be inclined against the gravity direction, the droplet 271 formed from the target 27 may be output obliquely downward from the ejection port 269*a* along the target travel path 272.

Further, the adhering target 273 adhering to the surface of the nozzle member 264 around the ejection port 269*a,* rather than traveling in the chamber 2 along the target travel path 272, may flow down through the ejection face 267*a,* the first flow path 267*b,* and the second flow path 266*a* in this order.

For example, when ejecting of the target 27 is to be stopped, the inside of the tank main body 261 may be decompressed. Thereby, the ejected target 27 may lose the momentum, and adhere to the surface of the nozzle member 264 by the surface tension. The adhering target 273 may be made into a droplet on the surface of the nozzle member 264. When the adhering target 273 grows and the weight of the droplet overcomes the surface tension, the adhering target 273 flows down according to the inclination of the ejection face 267*a,* the first flow path 267*b,* and the second flow path 266*a*.

[4.3 Effect]

As in the present embodiment, the nozzle member 264 in which the center axis is disposed in an inclined manner with respect to the downward gravity direction may have the ejection face 267*a* formed around the ejection port 269*a,* and the angle θ1 defined by the ejection face 267*a* and the gravity axis may satisfy the condition of "0 degrees<θ1<90 degrees". Preferably, the angle θ1 may satisfy the condition of "10 degrees<θ1<80 degrees".

In that case, the ejection face 267*a* may be a face inclined against a horizontal plane. Accordingly, the adhering target 273 may flow down on the ejection face 267*a* according to the inclination of the ejection face 267*a,* without returning to the ejection port 269*a*.

As a result, the adhering target 273 may be less likely to be retained around the ejection port 269*a*. As the subsequent target 27 may be unlikely to be in contact with the adhering target 273, the ejecting direction of the target 27 may be unlikely to change. Thereby, it is possible to effectively suppress pollution of the member such as the EUV focusing mirror 23, for example, in the chamber 2 with the target 27 in which the ejecting direction is changed. Further, the adhering target 273 can be suppressed from being retained on the surface of the nozzle member 264. Accordingly, the number of times of maintenance for removing the adhering target 273 can be reduced. Consequently, the operating rate can be improved, Further, as in the present embodiment, the peripheral face of the protruding portion 267 may have the first flow path 267*b* inclined from the lower end of the ejection face 267*a* in the inclination direction of the ejection face 267*a*. The first flow path 267*b* may be inclined such that the angle θ2 defined with the gravity axis satisfies the condition of "0 degrees<θ2<90 degrees". Preferably, the first flow path 267*b* may be inclined such that the angle θ2 satisfies the condition of "10 degrees<θ2<80 degrees".

In that case, the first flow path 267*b* may be a face inclined against a horizontal plane. Moreover, the first flow path 267*b* is inclined from the lower end of the ejection face 267*a* in the inclination direction of the ejection face 267*a*. Accordingly, the adhering target 273 flowing down on the ejection face 267*a* according to the inclination of the ejection face 267*a* may further flow down from the lower end of the ejection face 267*a* along the first flow path 267*b*.

As a result, the adhering target 273 may flow down from the ejection face 267*a* to the first flow path 267*b* and may be eliminated from the ejection face 267*a*.

In particular, the inclination of the first flow path 267*b* may be made such that the angle θ2 satisfies the condition of "θ1<θ2<90 degrees". In that case, the adhering target 273 flowing down on the ejection face 267*a* may be easily accumulated in the lower end portion of the ejection face 267*a*. When being accumulated in the lower end portion of the ejection face 267*a,* the adhering target 273 may become heavier and flow easily. Before being grown bigger on the ejection face 267*a,* the adhering target 273 flowing down can flow down from the ejection face 267*a* to the first flow path 267*b*.

Further, in the case where the angle θ1 of the ejection face 267*a* satisfies the condition of "10 degrees<θ1<80 degrees" and the angle θ2 of the first flow path 267*b* satisfies the condition of "10 degrees<θ2<80 degrees", the angle defined by the ejection face 267*a* and the first flow path 267*b* may be an obtuse angle of 110 degrees or larger. Thereby, the adhering target 273 reaching the lower end of the ejection face 267*a* may be less likely to drop from the lower end of the ejection face 267*a*. Meanwhile, if the angle defined by the ejection face 267*a* and the first flow path 267*b* is about 90 degrees, the flowing direction of the target 27 is changed abruptly. Thereby, the target 27 reaching the lower end of the ejection face 267*a* may be more likely to drop from the lower end of the ejection face 267*a*.

Further, as in the present embodiment, the base face 266 of the substrate portion 265 may be provided with the second flow path 266*a* inclined in the inclination direction of the first flow path 267*b,* from the lower end of the first flow path 267*b* in the protruding portion 267. The second flow path 266*a* may be inclined such that an angle θ3 defied with the gravity axis satisfies a condition of "0 degrees<θ3<90 degrees". Preferably, the second flow path 266*a* may be inclined such that the angle θ3 satisfies a condition of "10 degrees<θ3<80 degrees".

In that case, the second flow path 266*a* can be a surface inclined against a horizontal plane. Moreover, the second flow path 266*a* is inclined from the lower end of the first flow path 267*b* to the inclination direction of the first flow path 267*b*. Accordingly, the adhering target 273 flowing down on the peripheral face of the protruding portion 267 according to the inclination of the first flow path 267*b* may further flow down from the lower end of the first flow path 267*b* along the second flow path 266*a*.

As a result, the adhering target 273 may flow down from the first flow path 267*b* of the protruding portion 267 to the second flow path 266*a* of the base face 266 of the substrate portion 265, and may be eliminated from the protruding portion 267.

In particular, the inclination of the second flow path 266*a* may be made such that the angle θ3 satisfies the condition of "0 degrees<θ3<θ2". In that case, the adhering target 273 flowing down on the protruding portion 267 may be accelerated on the second flow path 266*a* of the base face 266 of the substrate portion 265, and may flow easily. The adhering target 273 that is accumulated in the lower end portion of the ejection face 267*a* and becomes heavier may be eliminated efficiently by the angled second flow path 266*a*.

Further, the heavier and faster adhering target 273 may drop preferably from the surface of the nozzle member 264 at the lower end of the second flow path 266*a* of the base face 266 of the substrate portion 265.

Further, in the case where the angle θ2 of the first flow path 267*b* satisfies the condition of "10 degrees<θ2<80 degrees " and the angle θ3 of the second flow path 266*a* satisfies the condition of "10 degrees<θ3<80 degrees", the angle defined by the first flow path 267*b* and the second flow path 266*a* may be an obtuse angle equal to or larger than 110 degrees. Thereby, the adhering target 273 flowing along the first flow path 267*b* may be less likely to abut the second flow path 266*a* to be retained. Meanwhile, if the angle defined by the first flow path 267*b* and the second flow path 266*a* is about 90 degrees, for example, the flow direction of the target 27 is changed abruptly, whereby the target 27 flowing through the first flow path 267*b* may abut the second flow path 266*a* to be retained easily.

As described above, the surface of a portion of a section of the nozzle member 264, from the ejection port 269*a* of the target 27 to the position where the adhering target 273 drops from the nozzle member 264, may be configured of a surface in which an angle θ defined with the gravity axis satisfies the condition of "0 degrees<θ<90 degrees". Preferably, the inclination of the surface may be made such that the angle θ satisfies a condition of "10 degrees<θ<80 degrees".

In that case, the adhering target 273 is less likely to remain adhering around the ejection port 269*a*, as described above. The adhering target 273 can be eliminated efficiently from the periphery of the ejection port 269*a*.

It should be noted that as the nozzle member 264 is attached to the tip of the neck portion 262 of the tank main body 261 to be heated by the heater 711, the nozzle member 264 may be heated by the heater 711. Consequently, the adhering target 273 adhering to the nozzle member 264 may be maintained in a molten state.

As in the present embodiment, the pressure regulator 721 as a pressurizing device that pressurizes the target 27 stored in the tank main body 261, and the piezoelectric element 731 as an excitation device that vibrates the neck portion 262 may be provided. Thereby, the neck portion 262 can be vibrated in a state where the target 27 stored in the tank main body 261 is pressurized. The target 27 can be granulized and output into the chamber 2.

Moreover, the nozzle member 264 can be excited together with the neck portion 262 of the tank main body 261. Thereby, the downward flow of the adhering target 273 can be promoted by the vibration.

[5. Second Embodiment]

[5.1 Configuration]

Figure 6:
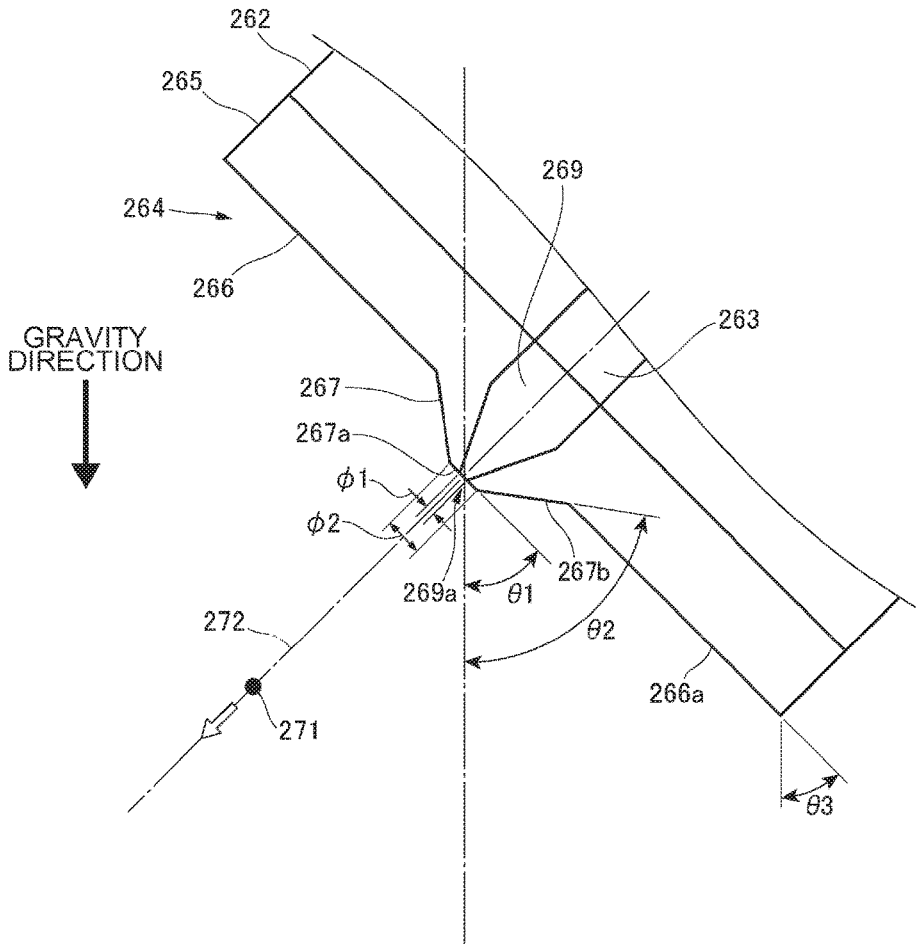
FIG. 6 illustrates a nozzle member and a target ejecting state of a second embodiment.

FIG. 6 illustrates the nozzle member 264 and a state of ejecting the target 27 of a second embodiment. In FIG. 6, the up and down direction of the sheet may be the gravity direction.

The nozzle member 264 of the second embodiment may include the substrate portion 265, the protruding portion 267, the ejection hole 269, the ejection face 267*a*, the first flow path 267*b*, and the second flow path 266*a*.

The substrate portion 265, the protruding portion 267, the ejection hole 269, the ejection face 267*a*, the first flow path 267*b*, and the second flow path 266*a* may be the same as those of the first embodiment except for the parts described below.

The ejection face 267*a* may be formed to be in a circular shape having a diameter Φ2 of 10 micrometers or larger but 20 micrometers or smaller.

The ejection port 269*a* formed at the center of the ejection face 267*a* by the ejection hole 269 may be formed to be in a circular shape having a diameter Φ1 of 2 micrometers or larger but 3 micrometers or smaller.

[5.2 Operation]

As illustrated in FIG. 6, in the case where the diameter Φ1 of the ejection port 269*a* is 2 micrometers or larger but 3 micrometers or smaller, the diameter of the droplet 271 may be several micrometers.

Further, after being ejected from the ejection port 269*a*, the adhering target 273 may flow down through the ejection face 267*a*, the first flow path 267*b*, and the second flow path 266*a* in this order.

[5.3 Effect]

As in the present embodiment, in the case where the diameter of the ejection port 269*a* is 2 micrometers or larger but 3 micrometers or smaller, the diameter of the droplet 271 may be several micrometers. In the case where the diameter of the ejection face 267*a* is 10 micrometers or larger but 20 micrometers or smaller, the length from the ejection port 269*a* of the ejection face 267*a* to the lower end of the ejection face 267*a* is larger than the diameter of the droplet 271, and the length can be equal to several pieces of the droplets 271.

As a result, the adhering target 273 flows to the lower end of the ejection face 267*a* to thereby be eliminated from the periphery of the ejection port 269*a*, and may grow to a droplet at a position separated from the periphery of the ejection port 269*a*. Accordingly, the target 27 ejected from the ejection port 269*a* can further be suppressed from being in contact with the adhering target 273.

[6. Third Embodiment]

[6.1 Configuration]

Figure 7:
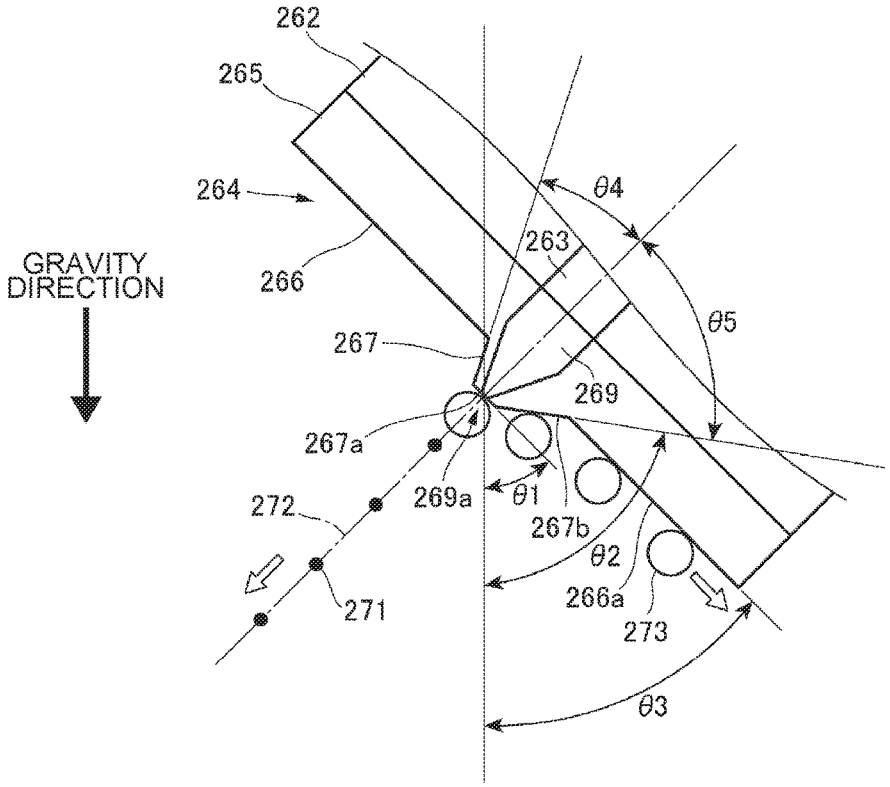
FIG. 7 illustrates a nozzle member and a target ejecting state of a third embodiment.

FIG. 7 illustrates the nozzle member 264 and a state of ejecting the target 27 of a third embodiment. In FIG. 7, the up and down direction on the sheet may be the gravity direction.

The nozzle member 264 of the third embodiment may include the substrate portion 265, the protruding portion 267, the ejection hole 269, the ejection face 267*a*, the first flow path 267*b*, and the second flow path 266*a*.

The substrate portion 265, the protruding portion 267, the ejection hole 269, the ejection face 267*a*, the first flow path 267*b*, and the second flow path 266*a* may be the same as those of the first embodiment except for the parts described below.

The protruding portion 267 may be formed asymmetrically with respect to the center axis of the ejection hole 269. The protruding portion 267 may be formed in an eccentric truncated elliptical cone shape in which the volume above the center axis is smaller than the volume below the center axis in the cross section in the gravity direction including the center axis, for example. Further, in the cross section in the gravity direction including the center axis, the protruding portion 267 may be formed in an eccentric truncated polygonal pyramid shape in which the volume above the center axis is smaller than the volume below the center axis.

Thereby, as illustrated in FIG. 7, the peripheral face of the protruding portion 267 is formed such that the angle of the lower portion with respect to the target travel path 272 may be larger than the angle of the upper portion with respect to the target travel path 272.

In FIG. 7, an angle θ5 defined by the lower portion and the target travel path 272 may be larger than an angle θ4 defined by the upper portion and the target travel path 272.

[6.2 Operation]

As illustrated in FIG. 7, after the adhering target 273 is ejected from the ejection port 269*a*, the adhering target 273 may flow down through the ejection face 267*a*, the first flow path 267*b*, and the second flow path 266*a*, in this order.

[6.3 Effect]

As in the present embodiment, when the protruding portion 267 is formed asymmetrically, on the peripheral face of the protruding portion 267, the angle of the lower portion with respect to the target travel path 272 may be larger than the angle of the upper portion with respect to the target travel path 272. Accordingly, the angle θ2 defined by the first flow path 267*b* on the peripheral face of the protruding portion 267 and the gravity axis can be small, while the angle θ1 defined by the ejection face 267*a* and the gravity axis and the angle θ3 defined by the second flow path 266*a* on the base face 266 of the substrate portion 265 and the gravity axis are the same as those of the first embodiment.

As a result, the angle defined by the ejection face 267*a* and the first flow path 267*b* and the angle defined by the first flow path 267*b* and the second flow path 266*a* can be larger, without changing the angle of the nozzle member 264. The flow of the target 27 on the surface of the nozzle member 264 can be regulated preferably by changing the angle of the surface of the nozzle member 264 while maintaining the angle of the nozzle member 264 conforming to the required specification of the target travel path 272.

[7. Fourth Embodiment]

[7.1 Configuration]

Figure 8:
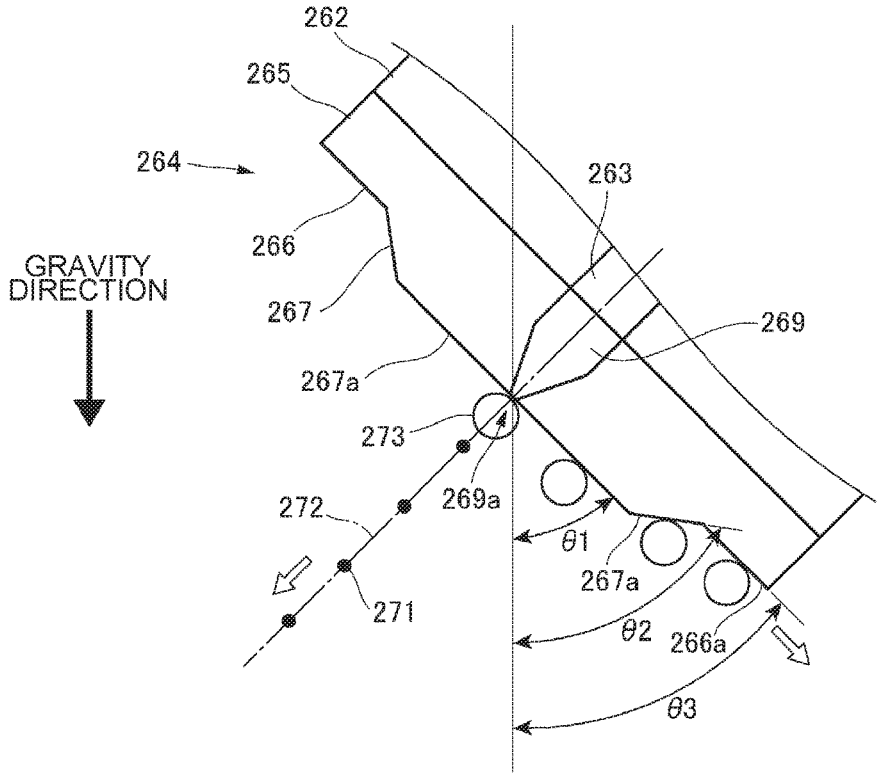
FIG. 8 illustrates a nozzle member and a target ejecting state of a fourth embodiment.

FIG. 8 illustrates the nozzle member 264 and a state of ejecting the target 27 of a fourth embodiment. In FIG. 8, the up and down direction on the sheet may be the gravity direction.

The nozzle member 264 of the fourth embodiment may include the substrate portion 265, the protruding portion 267, the ejection hole 269, the ejection face 267*a*, the first flow path 267*b*, and the second flow path 266*a*.

The substrate portion 265, the protruding portion 267, the ejection hole 269, the ejection face 267*a*, the first flow path 267*b*, and the second flow path 266*a* may be the same as those of the first embodiment except for the parts described below.

The protruding portion 267 may be formed in a truncated cone shape having a larger diameter than that of the first embodiment.

The ejection face 267*a* may be formed in a circular shape having a larger diameter than that of the first embodiment.

[7.2 Operation]

As illustrated in FIG. 8, after the adhering target 273 is ejected from the ejection port 269*a*, the adhering target 273 may flow down through the ejection face 267*a*, the first flow path 267*b*, and the second flow path 266*a*, that are on the surface of the nozzle member 264, in this order.

[7.3 Effect]

As in the present embodiment, the ejection face 267*a* may be formed in a circular shape having a large diameter. Thereby, the length from the ejection port 269*a* of the ejection face 267*a* to the lower end of the ejection face 267*a* can be significantly larger than a droplet of the target 27.

As a result, the possibility that the target 27 ejected from the ejection port 269*a* is brought into contact with the adhering target 273 can be reduced significantly.

[8. Fifth Embodiment]

[8.1 Configuration]

Figure 9:
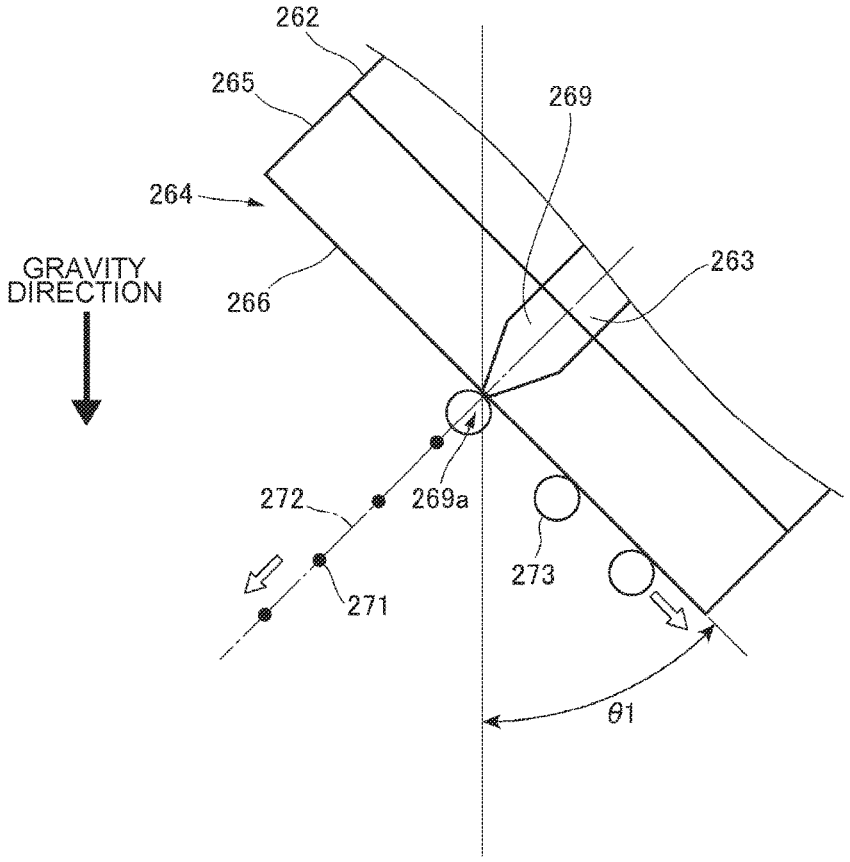
FIG. 9 illustrates a nozzle member and a target ejecting state of a fifth embodiment.

FIG. 9 illustrates the nozzle member 264 and a state of ejecting the target 27 of a fifth embodiment. In FIG. 9, the up and down direction on the sheet may be the gravity direction.

The nozzle member 264 of the fifth embodiment may include the substrate portion 265, the ejection hole 269, and an ejection face.

The ejection face may be the base face 266 of the inclined substrate portion 265.

The inclination of the base face 266 may be made such that the angle θ1, defined by the base face 266 as the ejection face and the gravity axis, satisfies the condition of "0 degrees<θ1<90 degrees". Preferably, the inclination of the ejection face may he made such that the angle θ1 satisfies conditions of "10 degrees<θ1<80 degrees".

The substrate portion 265 and the ejection hole 269 may be the same as those of the first embodiment.

[8.2 Operation]

As illustrated in FIG. 9, after the adhering target 273 is ejected from the ejection port 269*a*, the adhering target 273 may flow down through the base face 266 as the ejection face.

[8.3 Effect]

As in the present embodiment, the base face 266 of the substrate portion 265 as the ejection face is inclined with respect to the downward direction in the gravity direction, and the angle θ1 defined by the base face 266 as the ejection face and the gravity axis may satisfy the condition of "0 degrees<θ1<90 degrees". Preferably, the angle θ1 may satisfy the condition of "10 degrees<θ1<80 degrees".

In that case, the base face 266 as the ejection face may be a plane inclined against the horizontal plane. Accordingly, the adhering target 273 may flow down on the base face 266 according to the inclination of the base face 266 as the ejection face.

As a result, the adhering target 273 may be less likely to remain adhering to the periphery of the ejection port 269*a*, It can be less likely that the subsequent target 27 is ejected while the adhering target 273 remains adhering to the periphery of the ejection port 269*a*. The ejecting direction of the target 27 may be less likely to be changed. Further, it is possible to effectively suppress pollution of the member such as the ETV focusing mirror 23 in the chamber 2 by the target 27 with the ejecting direction changed.

[9. Sixth Embodiment]

[9.1 Configuration]

Figure 10:
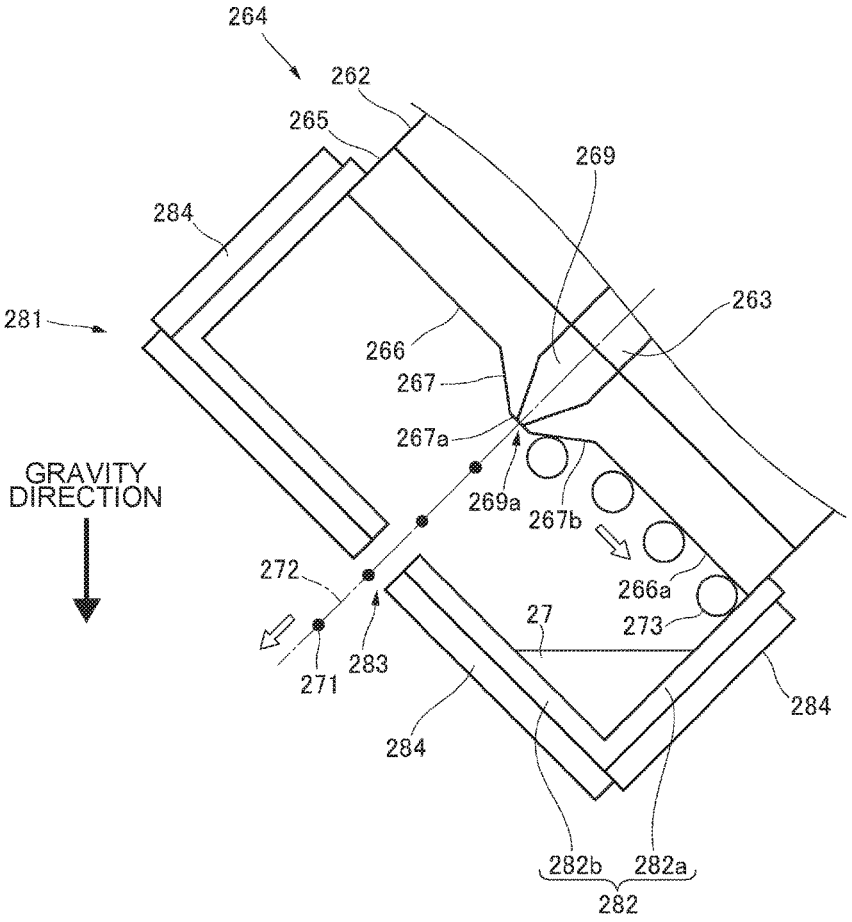
FIG. 10 illustrates a nozzle member, a nozzle cover, and a target ejecting state of a sixth embodiment.

FIG. 10 illustrates the nozzle member 264, a nozzle cover 281, and a state of ejecting the target 27 of a sixth embodiment. In FIG. 10, the up and down direction of the sheet may be the gravity direction.

The nozzle member 264 of the sixth embodiment may include the substrate portion 265, the protruding portion 267, the ejection hole 269, the ejection face 267*a*, the first flow path 267*b*, and the second flow path 266*a*, similar to that of the first embodiment.

The substrate portion 265, the protruding portion 267, the ejection hole 269, the ejection face 267*a*, the first flow path 267*b*, and the second flow path 266*a* may be the same as those of the first embodiment.

The sixth embodiment may also include the nozzle cover 281 as a receiving member covering the entire nozzle member 264.

The nozzle cover 281 may include a cover main body 282, a cover hole 283, and a heater 284.

The cover main body 282 may be made of a metallic material having high heat conductivity. The cover main body 282 may include a cylinder side face portion 282*a* and a bottom face portion 282*b*. The cylinder side face portion 282*a* may be formed to have an inner diameter capable of being fitted to the neck portion 262. The bottom face portion 282*b* may be integrated with the cylinder side face portion 282*a* so as to close the bottom face of the cylinder side face portion 282*a*. The cover hole 283 may be formed at a position where the bottom face portion 282*b* and the center axis of the ejection hole 269 of the nozzle member 264 intersect. The cover hole 283 may be formed at the center of the bottom face portion 282*b*.

The heater 284 may be provided on the outer face of the cover main body 282. The heater 284 may be connected with the heater power source 712.

The neck portion 262 may be fitted in the nozzle cover 281. Thereby, the nozzle member 264 can be covered with the nozzle cover 281.

[9.2 Operation]

As illustrated in FIG. 10, when the center axis of the nozzle member 264 is provided to be inclined against the gravity direction, the droplet 271 formed from the target 27 may be output obliquely downward from the ejection port 269*a* along the target travel path 272. The droplet 271 may pass through the cover hole 283 of the nozzle cover 281 and travel into the chamber 2.

Meanwhile, when the adhering target 273 is generated, after being ejected from the ejection port 269*a*, the adhering target 273 may flow down through the ejection face 267*a*, the first flow path 267*b*, and the second flow path 266*a*, that are on the surface of the nozzle member 264. The adhering target 273 that reached the lower end of the nozzle member 264 may drop from the nozzle member 264 and may be collected inside the cover main body 282 of the nozzle cover 281. The adhering target 273 collected inside the cover main body 282 may be maintained in a molten state by being heated by the heater 284.

[9.3 Effect]

As in the present embodiment, when the nozzle member 264 is covered with the nozzle cover 281, after the adhering target 273 flows down through the surface of the inclined nozzle member 264, the adhering target 273 may drop from the nozzle member 264 and may be collected inside the nozzle cover 281.

As a result, in the present embodiment, it is possible to suppress pollution inside the chamber 2 caused by the adhering target 273 dropping from the nozzle member 264 into the chamber 2. The collected adhering target 273 is heated and melted by the heater 284. Accordingly, it may be less likely that the adhering target 273 is solidified and piled up in the nozzle cover 281 to thereby block the target travel path 272.

[10. Seventh Embodiment]

[10.1 Configuration]

Figure 11:
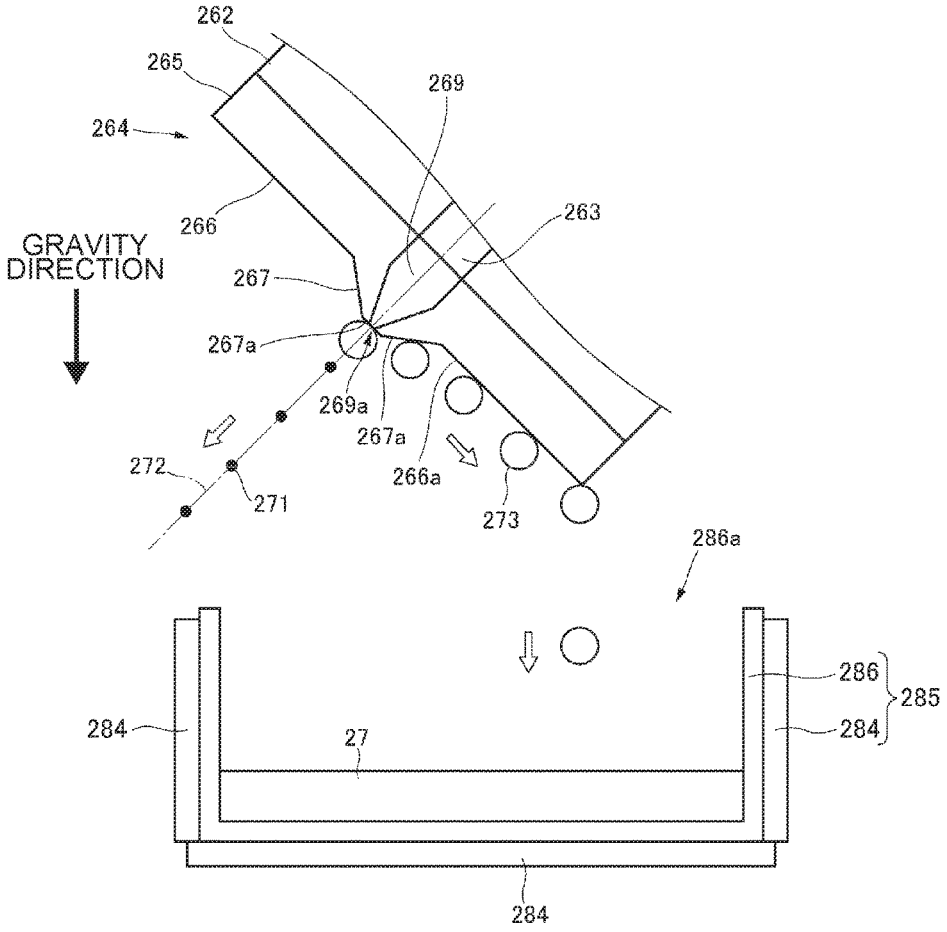
FIG. 11 illustrates a nozzle member, a separation receiving member, and a target ejecting state of a seventh embodiment.

FIG. 11 illustrates the nozzle member 264, a separation receiving member 285, and a state of ejecting the target 27 of a seventh embodiment. In FIG. 11, the up and down direction on the sheet may be the gravity direction.

The nozzle member 264 of the seventh embodiment may include the substrate portion 265, the protruding portion 267, the ejection hole 269, the ejection face 267*a*, the first flow path 267*b*, and the second flow path 266*a*, similar to that of the first embodiment.

The substrate portion 265, the protruding portion 267, the ejection hole 269, the ejection face 267*a*, the first flow path 267*b*, and the second flow path 266*a* may be the same as those of the first embodiment.

The seventh embodiment may also include the separation receiving member disposed below the lower end of the nozzle member 264 disposed in an inclined manner.

The separation receiving member 285 may include a receiver main body 286 and a heater 284.

The receiver main body 286 may be made of a metallic material having high heat conductivity. The receiver main body 286 may be formed in a box shape having an opening 286*a* on the top face. The opening 286*a* may be formed across the entire top face of the receiver main body 286, The receiver main body 286 may be disposed such that the opening 286*a* is positioned below the lower end of the nozzle member 264.

The heater 284 may be provided on the outer face of the receiver main body 286.

[10.2 Operation]

As illustrated in FIG. 11, after the adhering target 273 is ejected from the ejection port 269*a*, the adhering target 273 may flow down through the ejection face 267*a*, the first flow path 267*b*, and the second flow path 266*a*, that are on the surface of the nozzle member 264, in this order. The target 27 that reached the lower end of the nozzle member 264 may drop from the nozzle member 264, and may be collected inside the receiver main body 286 of the separation receiving member 285. The adhering target 273 collected inside the receiver main body 286 of the separation receiving member 285 may be maintained in a molten state by being heated by the heater 284.

[10.3 Effect]

As in the present embodiment, the separation receiving member 285 may be disposed below the lower end of the nozzle member 264 disposed in an inclined manner. Thereby, after flowing down through the surface of the nozzle member 264 having a predetermined inclined surface, the adhering target 273 may drop from the nozzle member 264, and may be collected by the separation receiving member 285.

As a result, in the present embodiment, the adhering target 273 can be collected by the separation receiving member 285. It is less likely that the adhering target 273 drops from the nozzle member 264 into the chamber 2 to pollute the inside of the chamber 2. The collected adhering target 273 is heated and melted by the heater 284. Accordingly, it is less likely that the adhering target 273 is solidified and piled up in the receiver main body 286 to thereby block the target travel path 272.

[11. Eighth Embodiment]

[11.1 Configuration]

Figure 12:
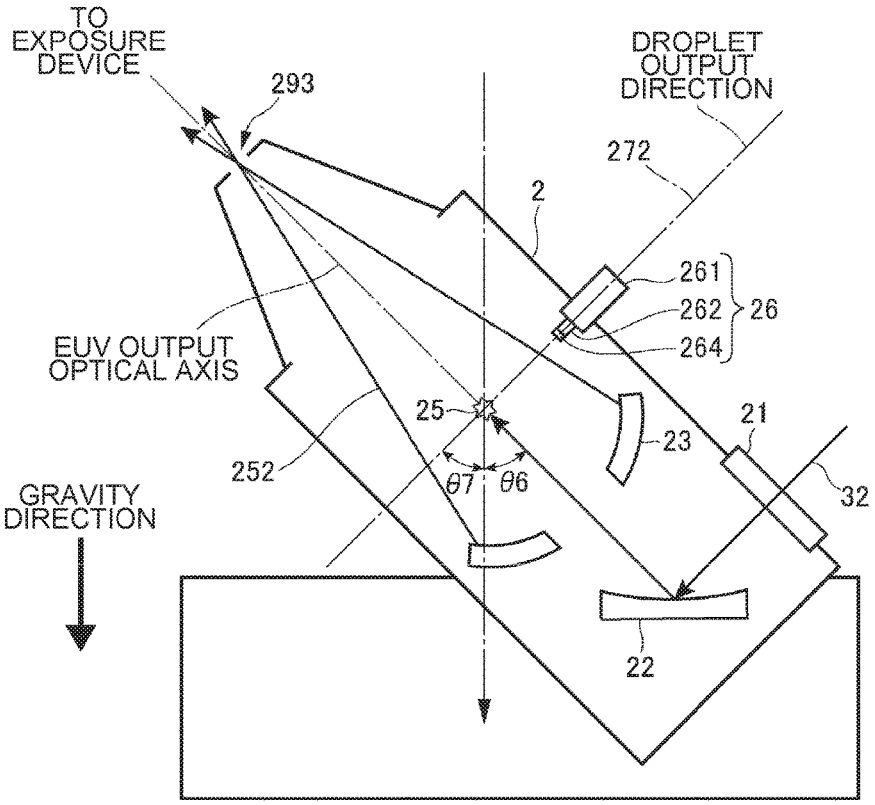
FIG. 12 illustrates an exemplary installation state of an EUV light generation device of an eighth embodiment.

FIG. 12 illustrates an exemplary installation state of the EUV light generation device 1 of an eighth embodiment. In FIG. 12, the up and down direction of the sheet may be the gravity direction.

In the eighth embodiment, the chamber 2 may be disposed in an inclined manner with respect to the gravity axis. An angle θ6 defined by the optical axis of the EUV light 252, reflected by the EUV focusing mirror 23, and the downward direction of the gravity axis may satisfy a condition of "0 degrees<θ6<90 degrees ".

Further, the target travel path 272 may be provided at an almost right angle with the optical axis of the EUV light 252. This means that an angle θ7 defined by the target travel path 272 and the gravity axis may satisfy a condition of "θ7=90 degrees−θ6". The angle θ7 may satisfy a condition of "10 degrees<θ7<80 degrees".

In that case, the tank main body 261 mounted on a side face of the chamber 2 may also be disposed in an inclined manner with respect to the gravity axis. The nozzle member 264 may be mounted at the tip of the neck portion 262 such that the center axis is inclined against the gravity direction.

[11.2 Operation]

As illustrated in FIG. 12, when the nozzle member 264 is provided to be inclined against the gravity direction while facing obliquely downward, the droplet 271 formed from the target 27 may be output obliquely downward from the ejection port 269*a* along the target travel path 272.

Meanwhile, when the adhering target 273 is generated, after the adhering target 273 is ejected from the ejection port 269*a,* the adhering target 273 may flow down through the ejection face 267*a,* the first flow path 267*b,* and the second flow path 266*a* in this order.

[11.3 Effect]

As in the present embodiment, the chamber 2 itself may be disposed to be inclined against the gravity axis. Thereby, the nozzle member 264 mounted at the tip of the neck portion of the tank main body 261 can be mounted on the chamber 2 in an inclined manner against the horizontal plane. When the ejection face 267*a* and the second flow path 266*a* are formed as planes vertical to the target travel path 272, the angles θ1 and θ3 may be equal to the angle θ6. In that case, if the condition of "0 degrees<θ6<90 degrees" is satisfied, the conditions "0 degrees<θ1<90 degrees" and "0 degrees<θ3<90 degrees" may also be satisfied. Regarding the first flow path 267*b,* it may be formed to satisfy a condition of "θ1<θ2<90 degrees" or a condition of "0 degrees<θ3<θ2". In this way, when the chamber 2 itself is disposed to be inclined against the gravity axis, the tank main body 261 may be mounted on the chamber 2 so as to satisfy the conditions regarding the angles θ1 and θ3.

Further, as the nozzle member 264 is mounted at the tip of the neck portion 262 of the tank main body 261, the nozzle member 264 is replaceable together with the tank main body 261. Even if the target 27 adheres to the surface of the nozzle member 264, for example, the nozzle member 264 is replaceable together with the tank main body 261. As a result, it is possible to prevent a state where the target 27 adheres to the nozzle member 264 for a long time.

Further, compared with the case where the tank main body 261 is mounted horizontally with respect to the chamber 2, for example, the protruding amount in a horizontal direction of the tank main body 261 from the chamber 2 can be suppressed. This may contribute to reduction of the size of the EUV light generation device 1.

[12. Ninth Embodiment]

[12.1 Configuration]

FIG. 13 illustrates exemplary materials of the nozzle member 264 of a ninth embodiment. FIG. 13 illustrates contact angles of the respective materials with respect to molten tin.

The target 27 may be tin, for example.

The nozzle member 264 of the ninth embodiment may be made of a material, a contact angle θt of which with the molten target 27 satisfies a condition of "90 degrees<θt<180 degrees". In general, when the contact angle is 90 degrees or smaller, immersional wetting may be caused, and the material may be immersed and sink. When the contact angle exceeds 90 degrees, adhesional wetting may be caused, and it is possible to prevent wetting of the material from progressing.

As illustrated in FIG. 13, materials of the nozzle member 264 causing adhesional wetting with respect to molten tin include silicon carbide, silicon nitride, aluminum oxide, zirconium oxide, black lead, diamond, silicon oxide, and molybdenum oxide, for example.

It should be noted that the nozzle member 264 may be formed such that not the entire nozzle member 264 is made of the material described above but at least the surface thereof is made of the material described above. For example, the surface of the nozzle member 264 may be coated with the material described above.

[12.2 Operation]

After the adhering target 273 is ejected from the ejection port 269*a,* the adhering target 273 may flow down through the ejection face 267*a,* the first flow path 267*b,* and the second flow path 266*a,* which are made of a material described above, in this order.

[12.3 Effect]

As in the present embodiment, the nozzle member 264 or the surface of the nozzle member 264 may be made of a material, the contact angle θt of which with the molten target 27 satisfies the condition of "90 degrees<θt<180 degrees". Thereby, the surface of the nozzle member 264 may resist being got wet by the molten target 27. The molten target 27 may be easily made into a droplet on the surface of the nozzle member 264, and may easily flow down through the surface of the nozzle member 264.

[13. Tenth Embodiment]

[13.1 Configuration]

The target 27 may be tin, for example.

The nozzle member 264 or the surface of the nozzle member 264 of a tenth embodiment may be made of a material that resists chemical reaction with the molten target 27.

The reactivity between molten tin and various types of materials may be as described below, for example.

Tungsten, tantalum, and molybdenum that are materials having high melting points may resist chemical reaction with the molten tin.

Silicon carbide, silicon nitride, aluminum oxide, zirconium oxide, diamond, silicon oxide, and molybdenum oxide may resist chemical reaction with the molten tin.

Tungsten oxide and tantalum oxide may resist chemical reaction with the molten tin.

Accordingly, tungsten, tantalum, molybdenum, silicon carbide, silicon nitride, aluminum oxide, zirconium oxide, diamond, silicon oxide, molybdenum oxide, tungsten oxide, or tantalum oxide may be used as a material of the nozzle member 264. Further, the surface of the nozzle member 264, that is, the surface on the outlet side of the ejection hole 269 of the nozzle member 264 may be coated with such a material. Alternatively, the entire surface of the nozzle member 264 may be coated with such a material.

The material of the nozzle member 264 may be a non-metallic material that seldom reacts with molten tin. The material may be silicon carbide, silicon nitride, silicon oxide such as quartz glass, aluminum oxide such as sapphire, black lead, or diamond, for example.

From a viewpoint that the spattering rate of ion generated at the time of generating plasma is low, diamond is preferable as the material.

Further, a face of the ejection hole 269 of the nozzle member 264, which is in contact with molten tin, may be coated with a material that seldom reacts with molten tin. Such a material may be molybdenum, tantalum, or tungsten, for example. Further, in such a metallic material, an oxide layer of the surface may be removed.

It should be noted that the nozzle member 264 may be formed such that not the entire member is made of a material described above but at least the surface of the nozzle member 264 is made of a material described above.

[13.2 Operation]

After the adhering target 273 is ejected from the ejection port 269*a*, the adhering target 273 may flow down through the ejection face 267*a*, the first flow path 267*b*, and the second flow path 266*a*, made of a material described above, in this order.

[13.3 Effect]

As in the present embodiment, the nozzle member 264 or the surface of the nozzle member 264 may be made of a material that resists chemical reaction with the molten target 27. Thereby, the surface of the nozzle member 264 can be less likely to react with the molten target 27.

The description provided above is intended to provide just examples without any limitations. Accordingly, it will be obvious to those skilled in the art that changes can be made to the embodiments of the present disclosure without departing from the scope of the accompanying claims.

The terms used in the present description and in the entire scope of the accompanying claims should be construed as terms "without limitations". For example, a term "including" or "included" should be construed as "not limited to that described to be included". A term "have" should be construed as "not limited to that described to be held". Moreover, a modifier "a/an" described in the present description and in the accompanying claims should be construed to mean "at least one" or "one or more".

What is claimed is:

1. An extreme ultraviolet light generation device comprising:

a chamber in which a target is irradiated with laser light and extreme ultraviolet light is generated; and a target supply unit configured to eject a target into the chamber, the target supply unit including a nozzle member that includes an ejection face having an ejection port configured to eject the target into the chamber, an angle θ1 defined by the ejection face and a gravity axis satisfying a condition of "0 degrees<θ1<90 degrees", wherein the nozzle member includes:

a substrate portion having a base face exposed to an inside of the chamber; and a protruding portion having the ejection face at a tip of the protruding portion, the protruding portion being formed to protrude from the base face, a diameter of the ejection port for the target, formed on the ejection face, is 2 micrometers or larger but 3 micrometers or smaller, and a diameter of the ejection face is 10 micrometers or larger but 20 micrometers or smaller.

2. The extreme ultraviolet light generation device according to claim 1, wherein the protruding portion includes a first flow path formed on a peripheral face of the protruding portion, the first flow path being formed to be inclined from a lower end of the ejection face in an inclination direction of the ejection face, and the first flow path is inclined such that an angle θ2 defined with the gravity axis satisfies a condition of "0 degrees<θ2<90 degrees".

3. The extreme ultraviolet light generation device according to claim 2, wherein the angle θ1 defined by the ejection face and the gravity axis and the angle θ2 defined by the first flow path and the gravity axis satisfy a condition of "θ1<θ2<90 degrees".

4. The extreme ultraviolet light generation device according to claim 2, wherein the substrate portion includes a second flow path formed on the base face of the substrate portion, the second flow path being formed to be inclined from a lower end of the first flow path in the protruding portion in an inclination direction of the first flow path, and the second flow path is inclined such that an angle θ3 defined with the gravity axis satisfies a condition of "0 degrees<θ3<90 degrees".

5. An extreme ultraviolet light generation device comprising:

a chamber in which a target is irradiated with laser light and extreme ultraviolet light is generated; and a target supply unit configured to eject a target into the chamber, the target supply unit including a nozzle member that includes an ejection face having an ejection port configured to eject the target into the chamber, an angle θ1 defined by the ejection face and a gravity axis satisfying a condition of "0degrees<θ1<90 degrees", wherein the nozzle member includes:

a substrate portion having a base face exposed to an inside of the chamber; and a protruding portion having the ejection face at a tip of the protruding portion, the protruding portion being formed to protrude from the base face, and the protruding portion is formed asymmetrically on the base face.

6. The extreme ultraviolet light generation device according to claim 1, further comprising a receiving member provided on a lower side in the gravity direction of the nozzle member, the receiving member being configured to receive the target dropping from a surface of the nozzle member, wherein in the nozzle member, a surface of a portion of a section from the ejection port to a position at which the target drops from the nozzle member is configured of a surface having an angle θ, defined with the gravity axis, that satisfies a condition of "0 degrees<θ<90degrees".

7. The extreme ultraviolet light generation device according to claim 1, wherein the angle θ1 defined by the ejection face and the gravity axis satisfies a condition of "10degrees<θ1<80 degrees".

8. The extreme ultraviolet light generation device according to claim 2, wherein the angle θ2 defined by the first flow path and the gravity axis satisfies a condition of "10degrees<θ2<80 degrees".

9. The extreme ultraviolet light generation device according to claim 4, wherein the angle θ3 defined by the second flow path and the gravity axis satisfies a condition of "10 degrees<θ3<80 degrees".

10. The extreme ultraviolet light generation device according to claim 6, wherein the angle θ defined by the surface of the portion of the section and the gravity axis satisfies a condition of "10 degrees<θ<80 degrees".

11. The extreme ultraviolet light generation device according to claim 1, wherein the target supply unit includes a tank main body configured to store the target in the tank main body, the tank main body includes a neck portion protruding to the inside of the chamber, and the nozzle member is disposed in a replaceable manner at a tip of the neck portion, and the ejection face is inclined against a horizontal plane in a state where the tank main body is mounted on the chamber.

12. The extreme ultraviolet light generation device according to claim 11, wherein the target supply unit includes:

a pressurizing device configured to pressurize the target stored in the tank main body; and an excitation device configured to vibrate the neck portion, and the target supply unit vibrates the neck portion in a state where the target in the tank main body is pressurized to granulate the target, and outputs the target into the chamber.

13. The extreme ultraviolet light generation device according to claim 1, wherein the target is a molten target, and at least a surface, exposed to the chamber, of the nozzle member is made of a material, a contact angle θt of which with the molten target satisfies a condition of "90 degrees<θt<180degrees".

14. The extreme ultraviolet light generation device according to claim 1, wherein the target is a molten target, and at least a surface, with which the molten target has a possibility of being brought into contact, of the nozzle member is made of a material having low reactivity with the molten target.

15. The extreme ultraviolet light generation device according to claim 5, further comprising:

a receiving member provided on a lower side in the gravity direction of the nozzle member, the receiving member being configured to receive the target dropping from a surface of the nozzle member, wherein in the nozzle member, a surface of a portion of a section from the ejection port to a position at which the target drops from the nozzle member is configured of a surface having an angle θ, defined with the gravity axis, that satisfies a condition of "0 degrees<θ<90 degrees".

16. The extreme ultraviolet light generation device according to claim 5, wherein the angle θ1 defined by the ejection face and the gravity axis satisfies a condition of "10degrees<θ1<80 degrees".

17. The extreme ultraviolet light generation device according to claim 5, wherein the protruding portion includes a first flow path formed on a peripheral face of the protruding portion, the first flow path being formed to be inclined from a lower end of the ejection face in an inclination direction of the ejection face, and the first flow path is inclined such that an angle θ2 defined with the gravity axis satisfies a condition of "0 degrees<θ2<90 degrees".

18. The extreme ultraviolet light generation device according to claim 17, wherein the angle θ2 defined by the first flow path and the gravity axis satisfies a condition of "10degrees<θ2<80 degrees".

19. The extreme ultraviolet light generation device according to claim 17, wherein the substrate portion includes a second flow path formed on the base face of the substrate portion, the second flow path being formed to be inclined from a lower end of the first flow path in the protruding portion in an inclination direction of the first flow path, and the second flow path is inclined such that an angle θ3 defined with the gravity axis satisfies a condition of "0 degrees<θ3<90 degrees".

20. The extreme ultraviolet light generation device according to claim 19, wherein the angle θ3 defined by the second flow path and the gravity axis satisfies a condition of "10 degrees<θ3<80 degrees".

* * * * *